US006253530B1

(12) United States Patent
Price et al.

(10) Patent No.: US 6,253,530 B1
(45) **Date of Patent: *Jul. 3, 2001**

(54) STRUCTURAL HONEYCOMB PANEL BUILDING SYSTEM

(76) Inventors: Tracy Price, 351 S. Carmelina, Los Angeles, CA (US) 90049; Robert L. Timbrook, P.O. Box 241811, Los Angeles, CA (US) 90024

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/916,900

(22) Filed: Aug. 25, 1997

Related U.S. Application Data

(63) Continuation of application No. 08/535,315, filed on Sep. 27, 1995, now abandoned.

(51) Int. Cl.[7] ..... E04C 2/30; E04B 1/00

(52) U.S. Cl. ..... 52/793.1; 52/794.1; 52/309.14; 52/592.1; 52/270; 156/920; 156/71; 428/116

(58) Field of Search ..... 52/793.1, 779, 52/309.15, 794.1, 592.1, 592.4, 784.14, 784.15, 309.14, 793.11, 270; 428/116; 156/920, 71

(56) References Cited

U.S. PATENT DOCUMENTS

| | | | | |
|---|---|---|---|---|
| 3,420,023 | * | 1/1969 | Gregori | 52/592.1 X |
| 4,150,175 | * | 4/1979 | Huettemann | 52/793.1 X |
| 4,294,055 | * | 10/1981 | Andresen | 52/790.1 X |
| 4,340,682 | * | 7/1982 | LeGue et al. | 524/507 |
| 4,603,531 | * | 8/1986 | Nash | 52/793.1 |
| 4,841,710 | * | 6/1989 | Considine | 59/745.1 X |
| 5,209,805 | * | 5/1993 | Spraggins | 156/578 X |
| 5,305,577 | * | 4/1994 | Richards et al. | 57/783.13 |

* cited by examiner

*Primary Examiner*—Robert Canfield
(74) *Attorney, Agent, or Firm*—Guy Porter Smith, Esq; Oppenheimer, Wolff & Donnelly LLP

(57) ABSTRACT

A structural honeycomb panel building system including fabrication methods and equipment provides integrated, modular structural components such as floors, walls, ceilings, trusses and roof members that can replace materials conventionally used in frame buildings. The panels are substantially impervious to moisture and other environmental hazards and may be inexpensively fabricated and assembled at the building site. The structural panels are fabricated, oriented depending upon the load bearing characteristics of each individual panel, interfitted and assembled to provide an assembly of structural panels with predetermined load bearing properties.

15 Claims, 27 Drawing Sheets

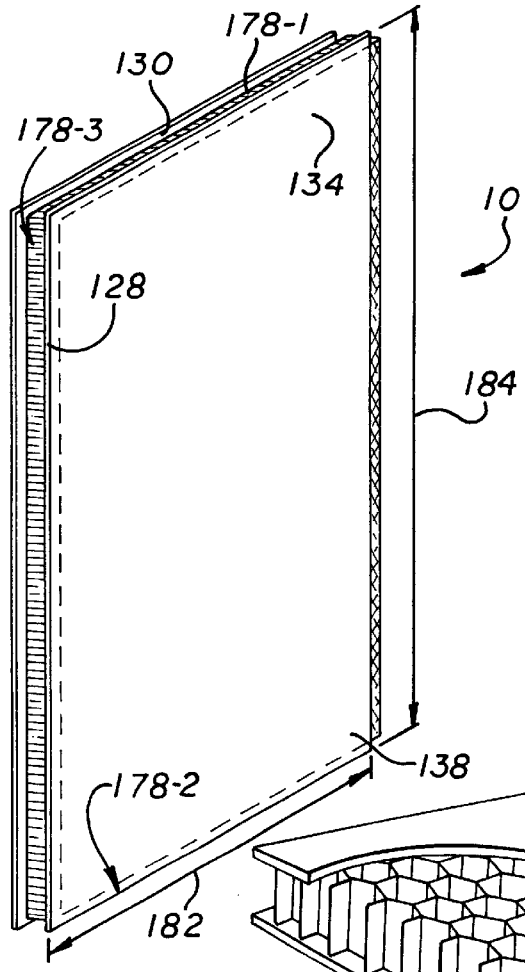
FIG. 2
FIG. 5a
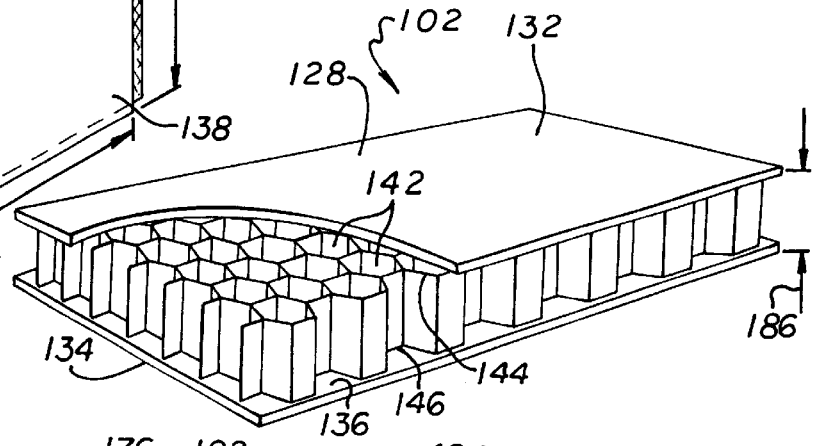
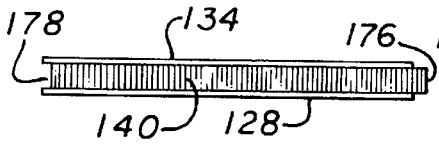
FIG. 4
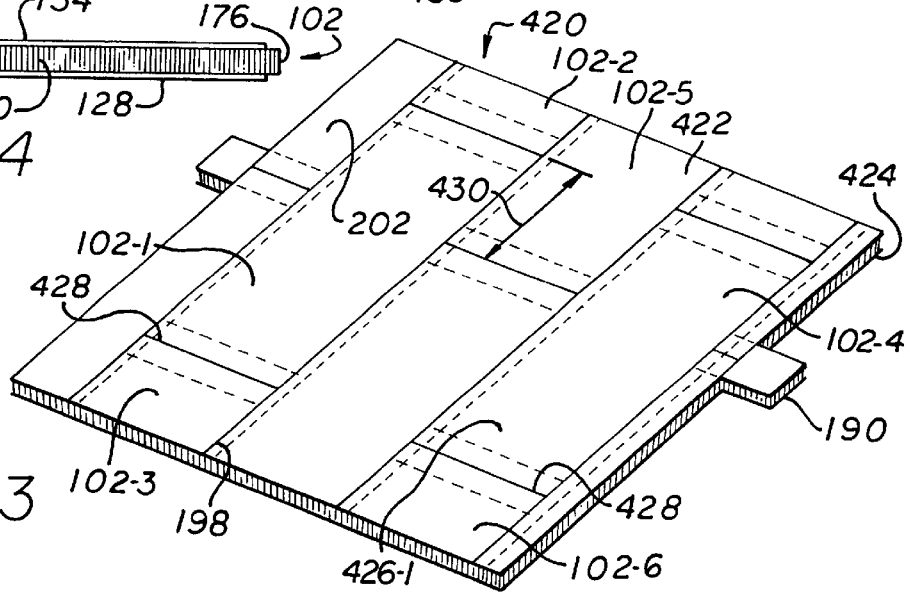
FIG. 3

FIG. 5e
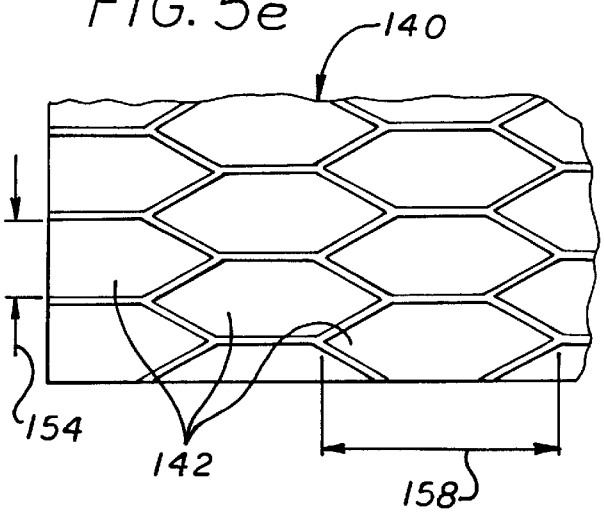
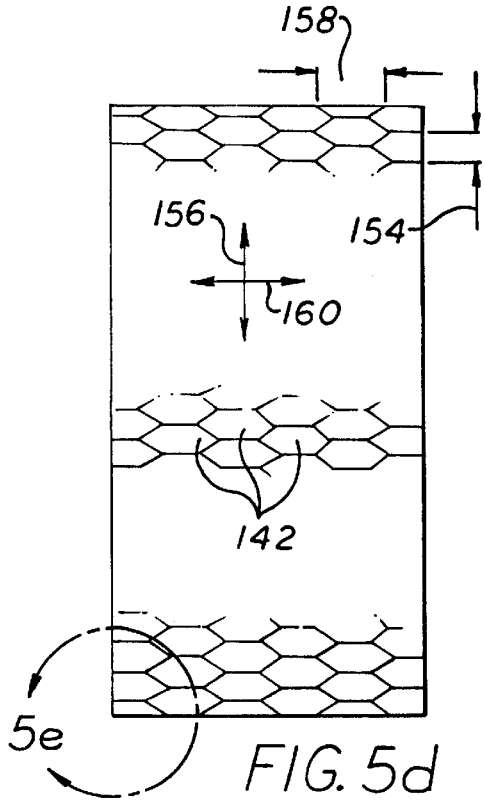
FIG. 5d
FIG. 5f
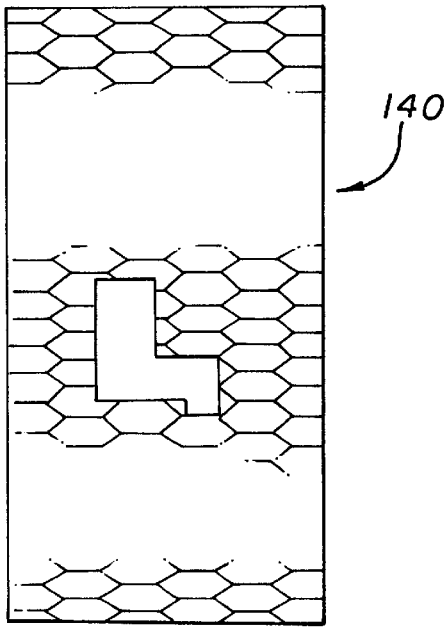
FIG. 5g
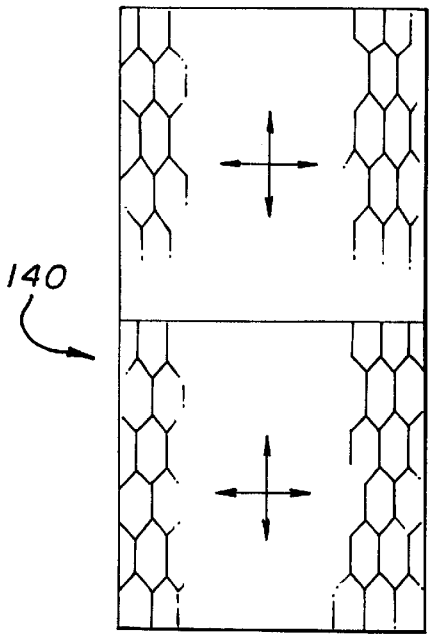

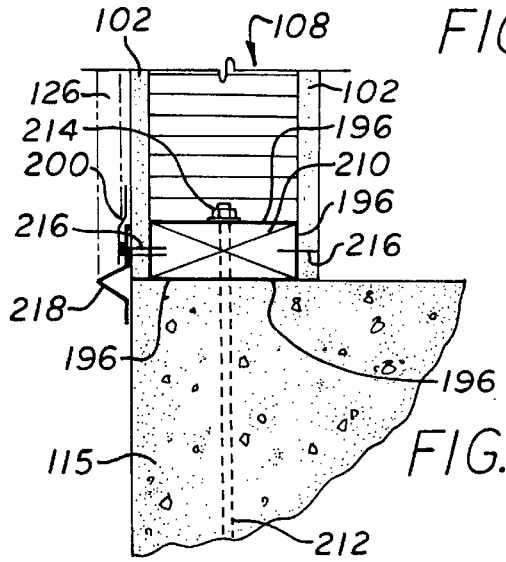
FIG. 6
FIG. 8
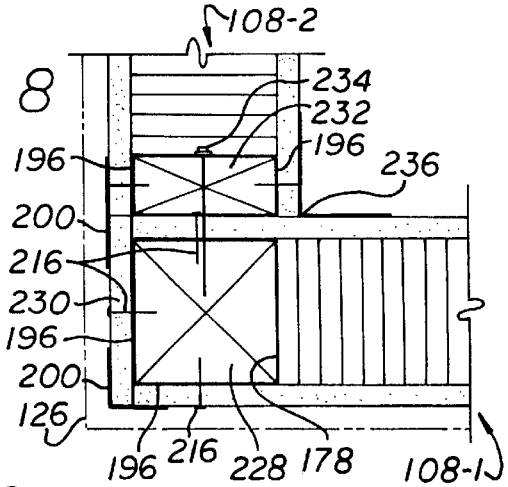
FIG. 7a
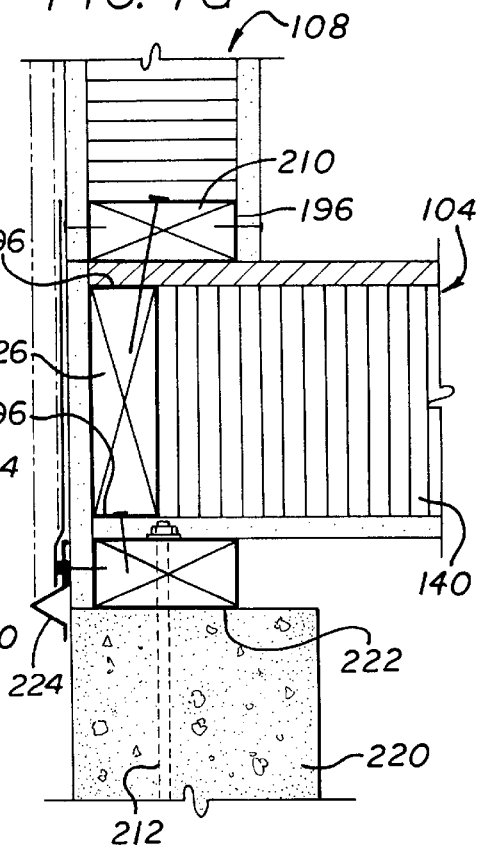
FIG. 7
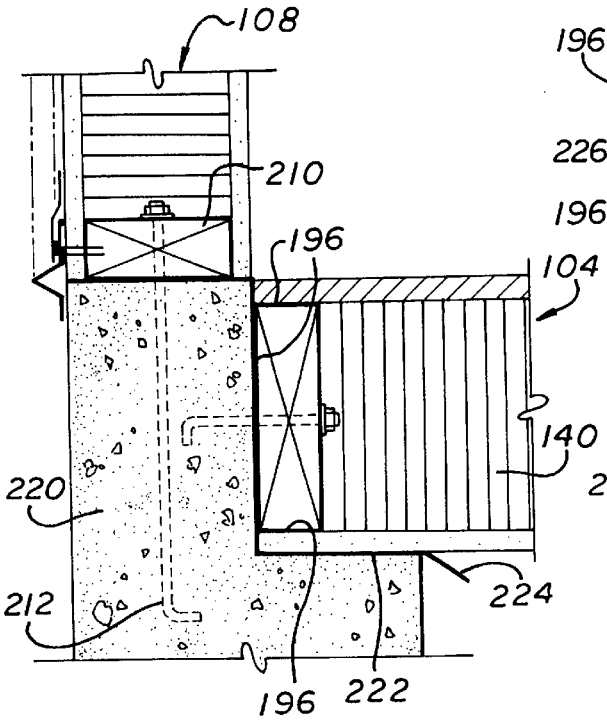

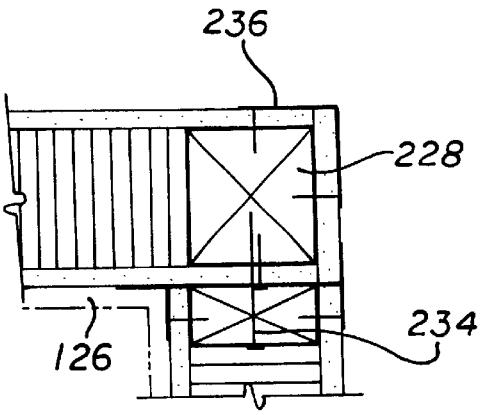
FIG. 9
FIG. 10
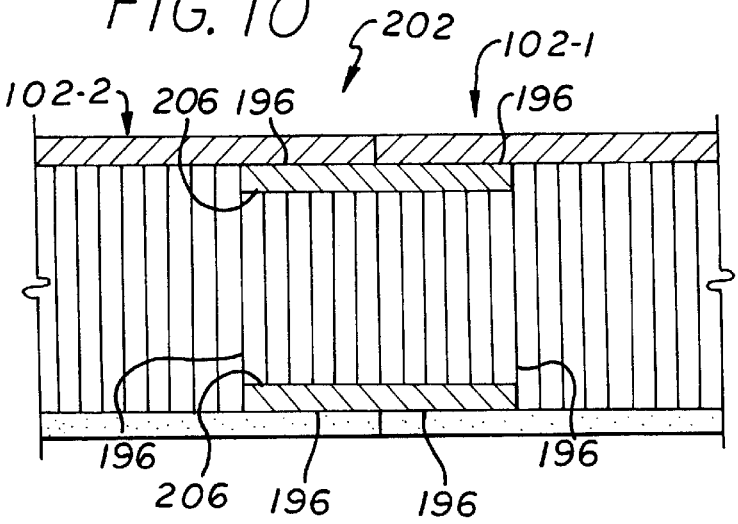
FIG. 10a
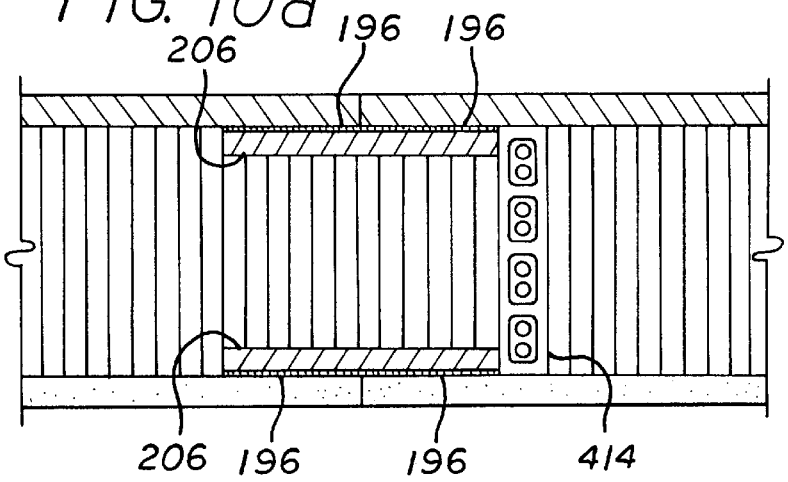

FIG. 11
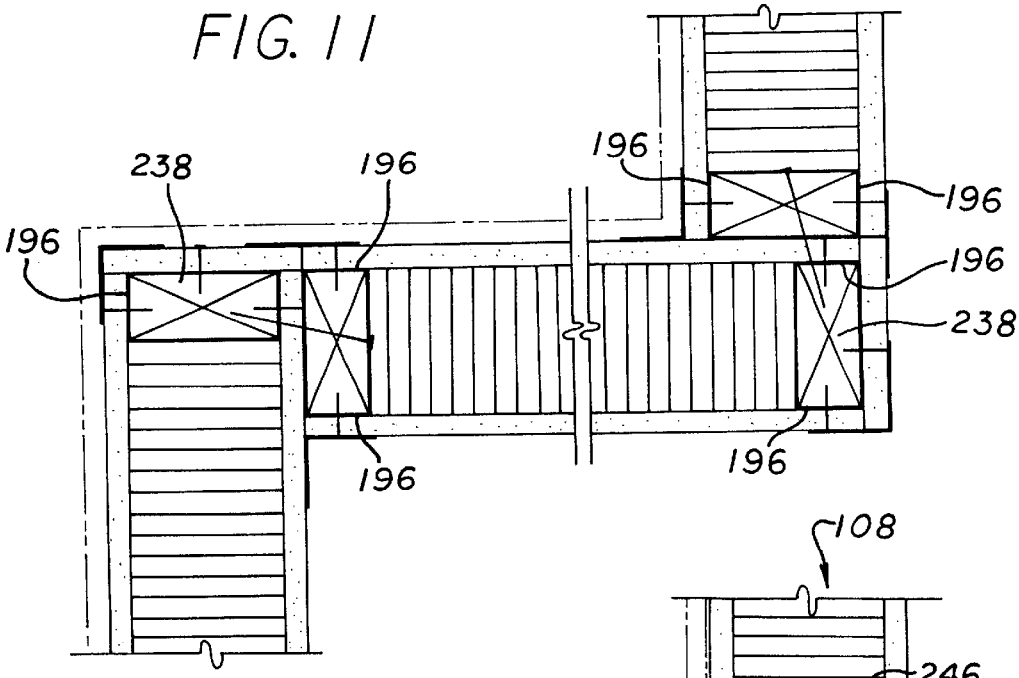
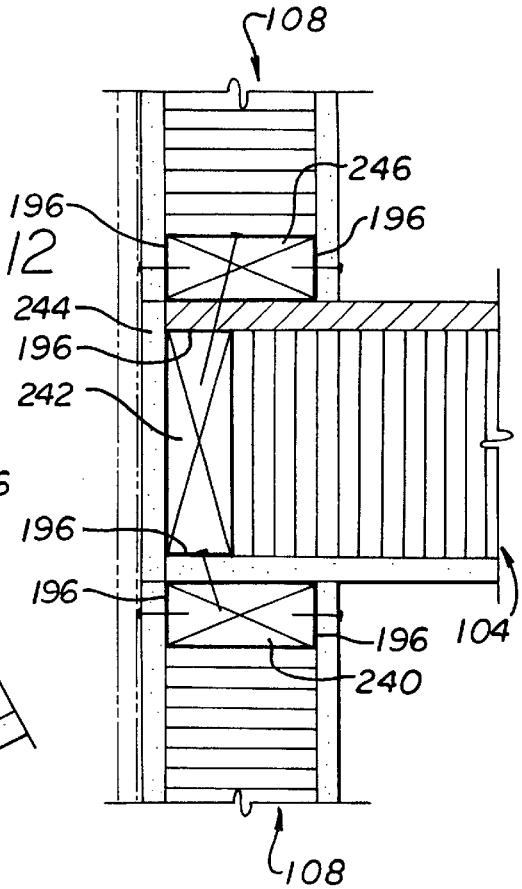
FIG. 12
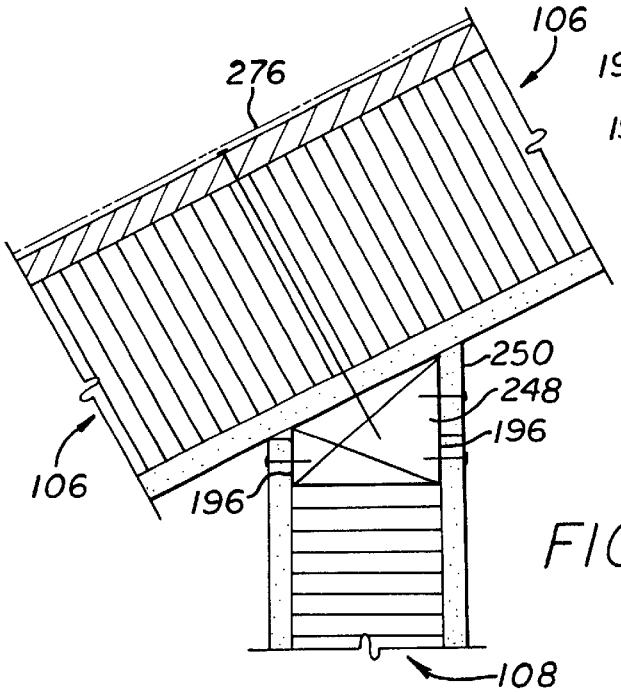
FIG. 13

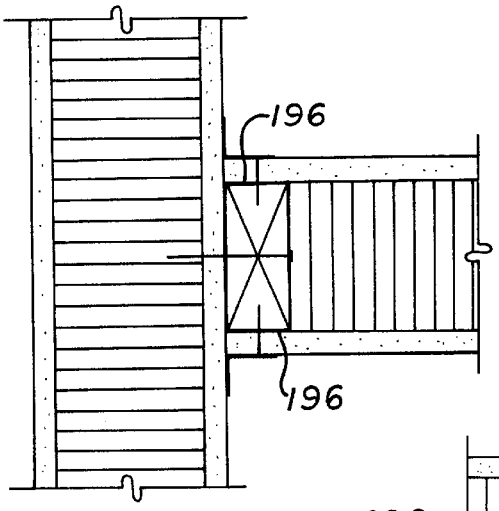
FIG. 14
FIG. 15
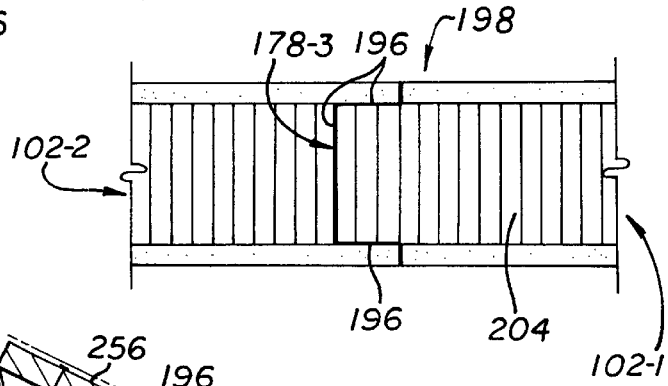
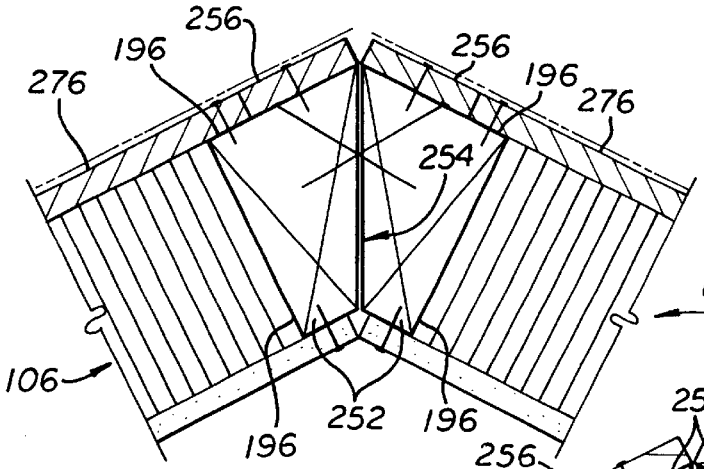
FIG. 16
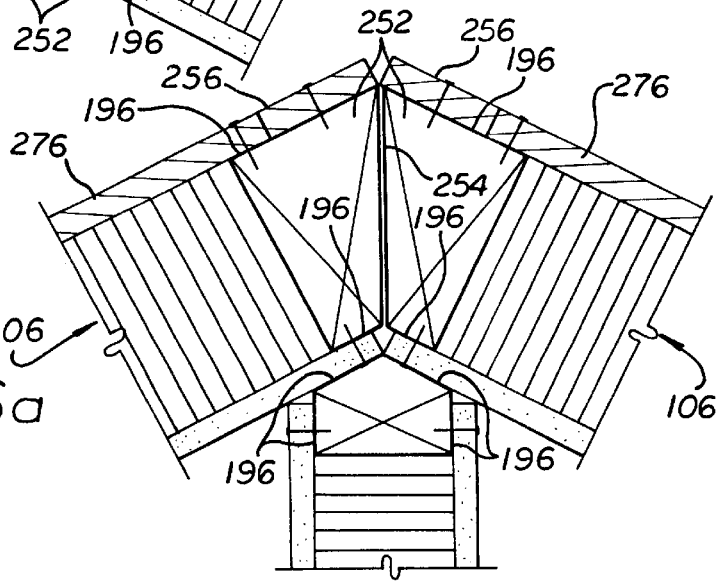
FIG. 16a

FIG. 29
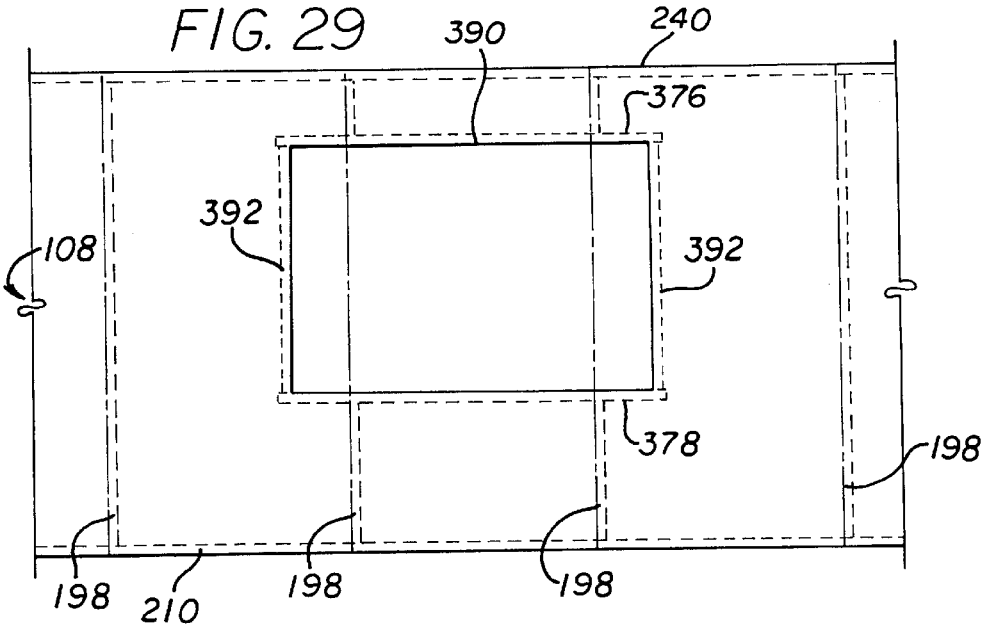
FIG. 28
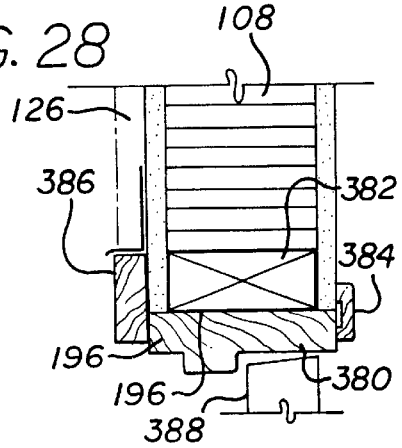
FIG. 30
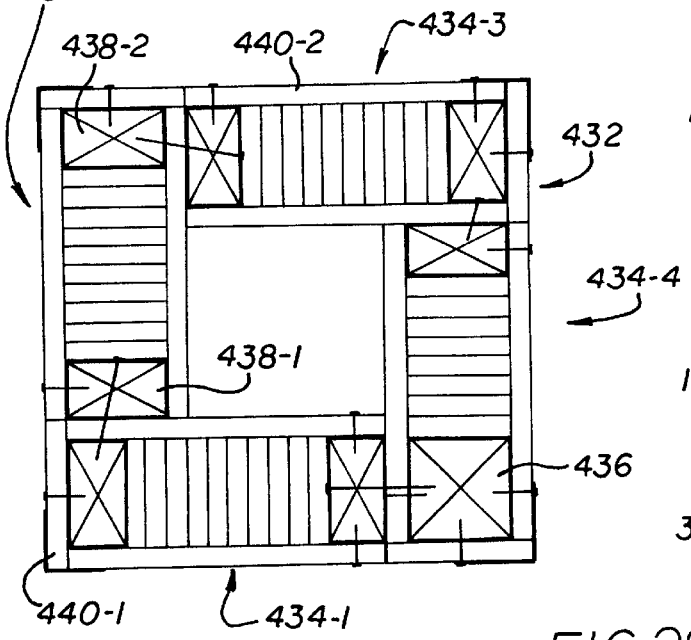
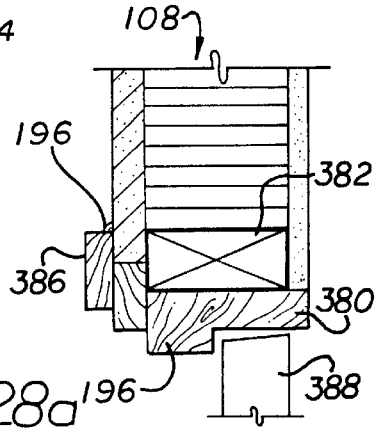
FIG. 28a

FIG. 31
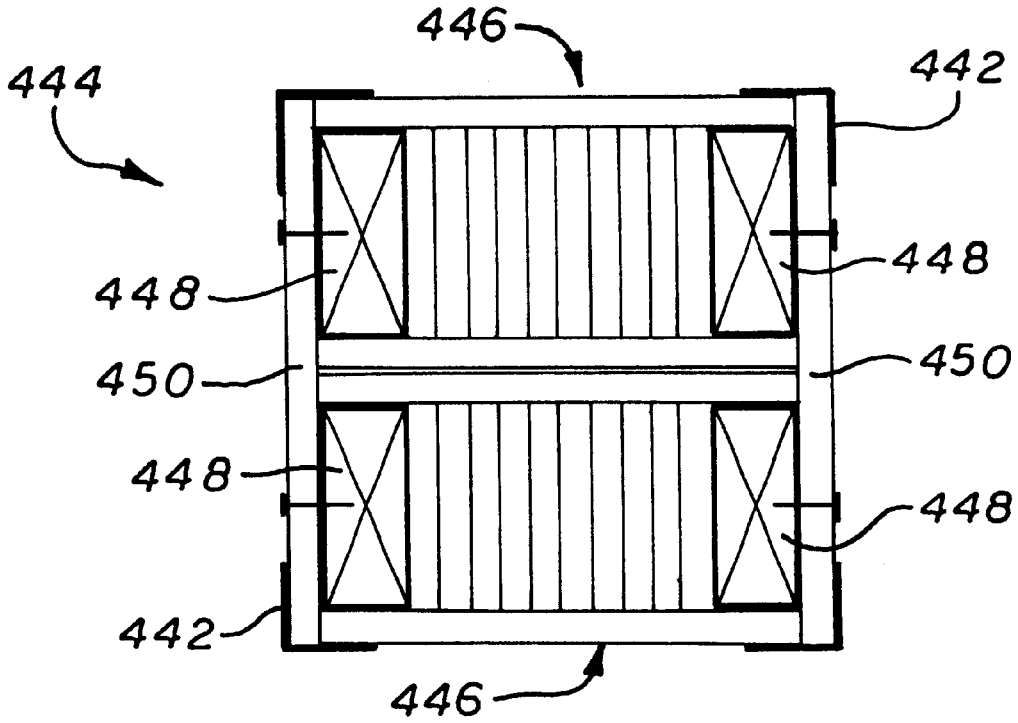
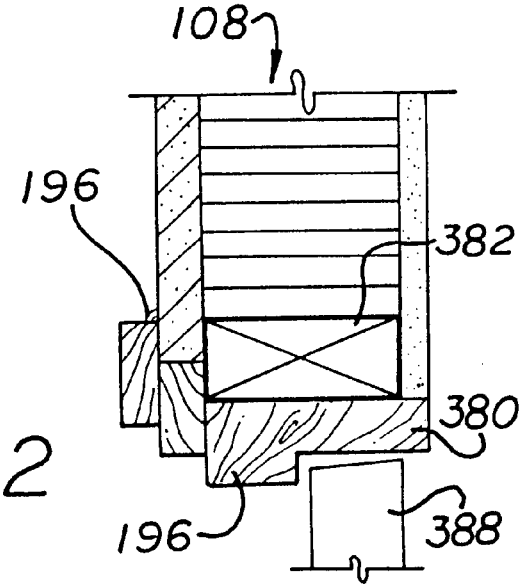
FIG. 32

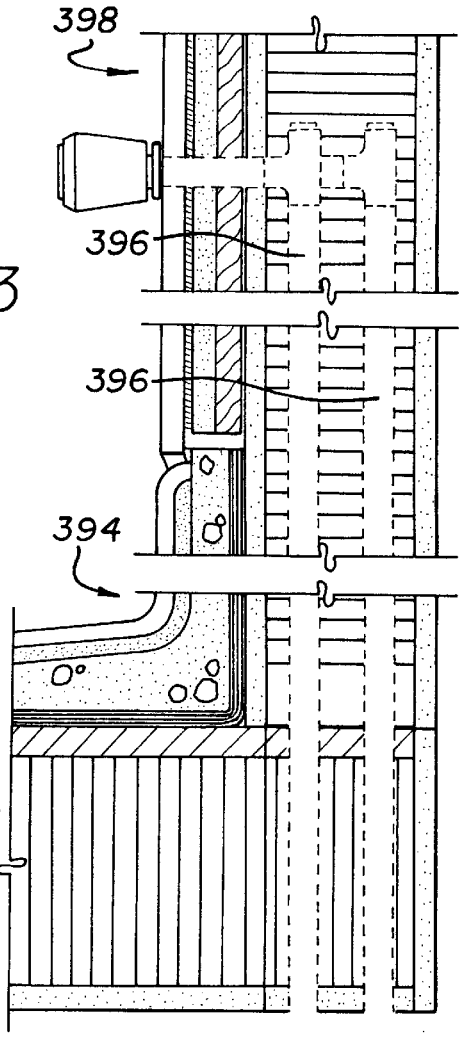
FIG. 33
FIG. 34
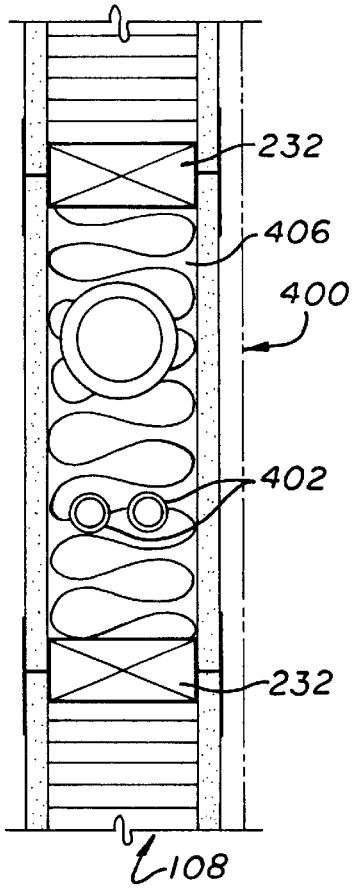
FIG. 34a
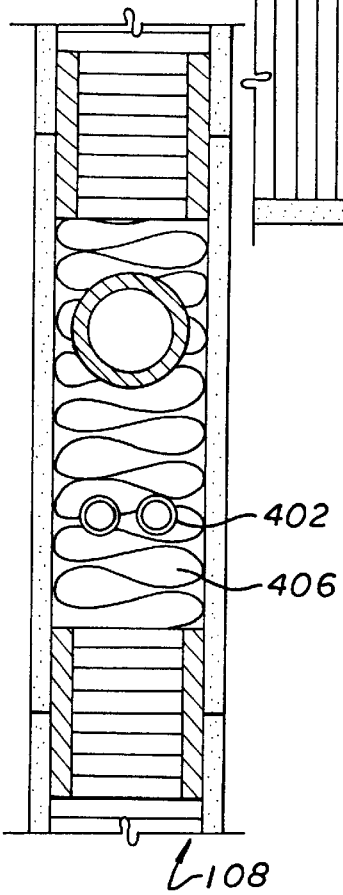

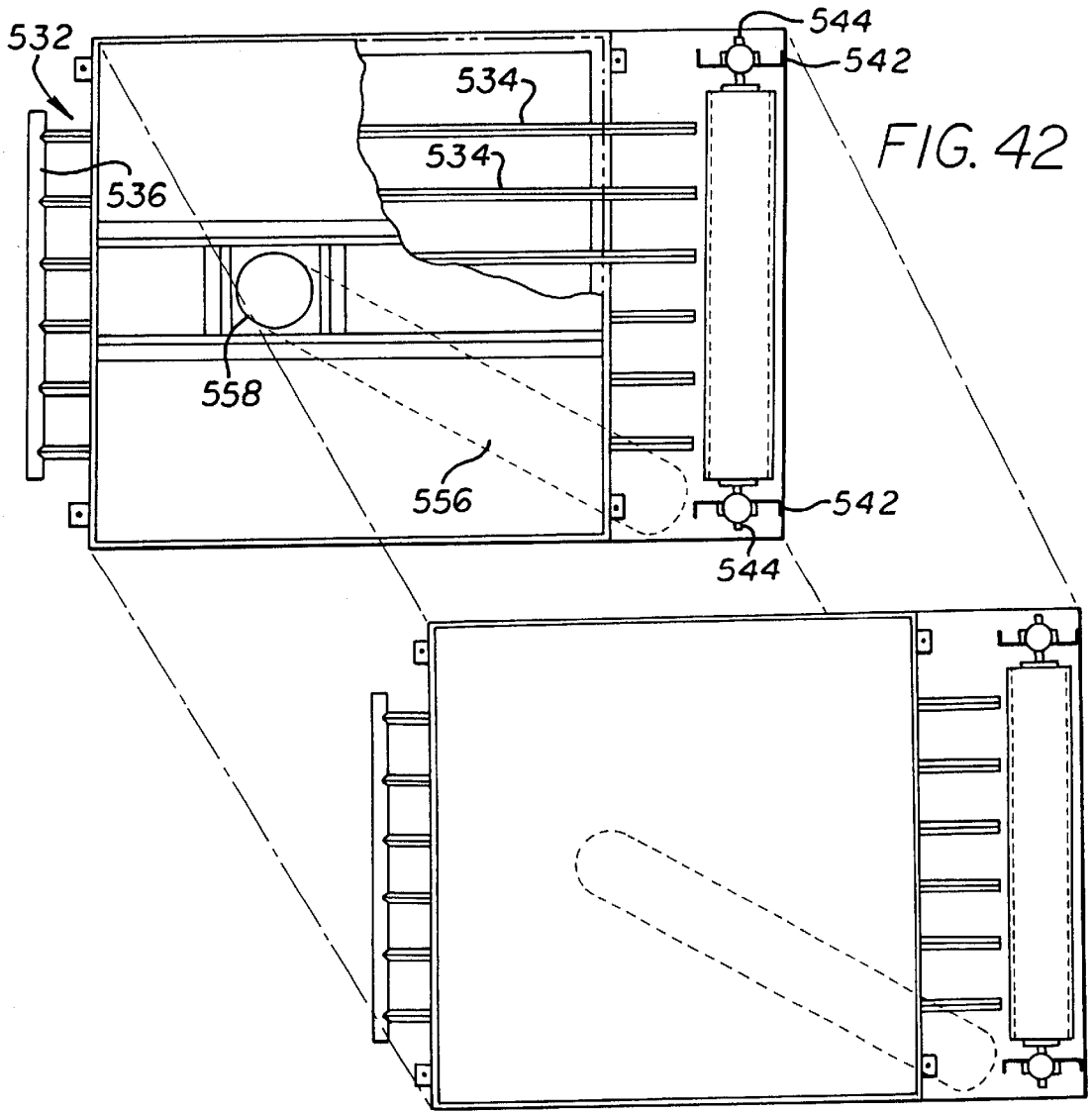
FIG. 42
FIG. 43
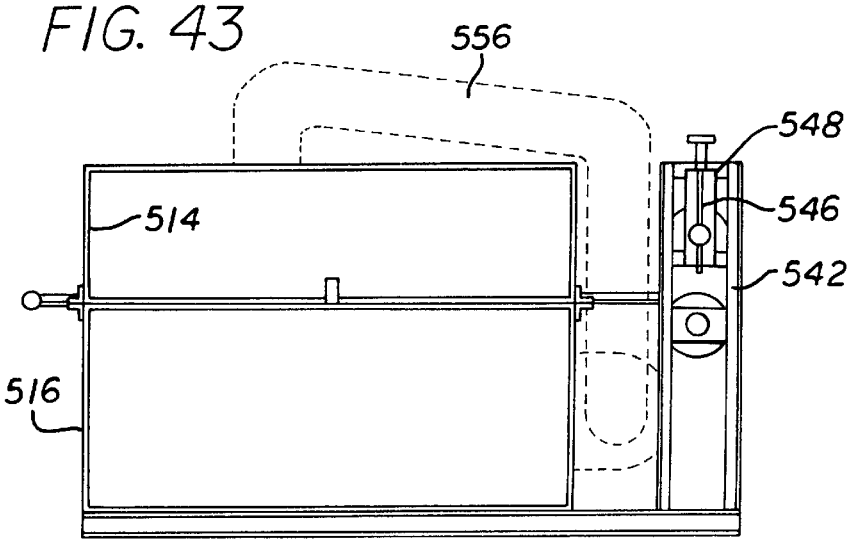

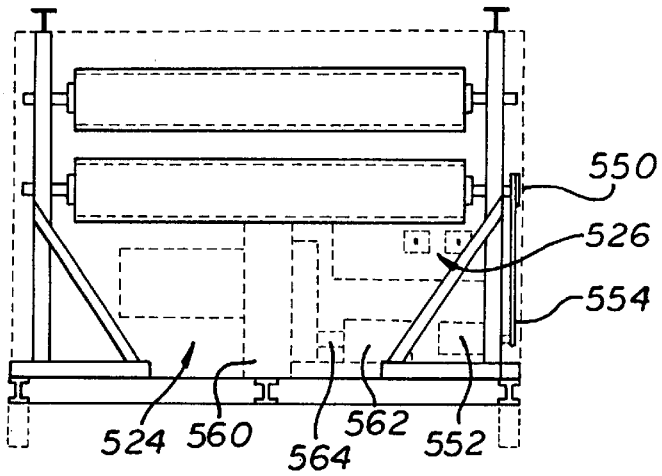
FIG. 44
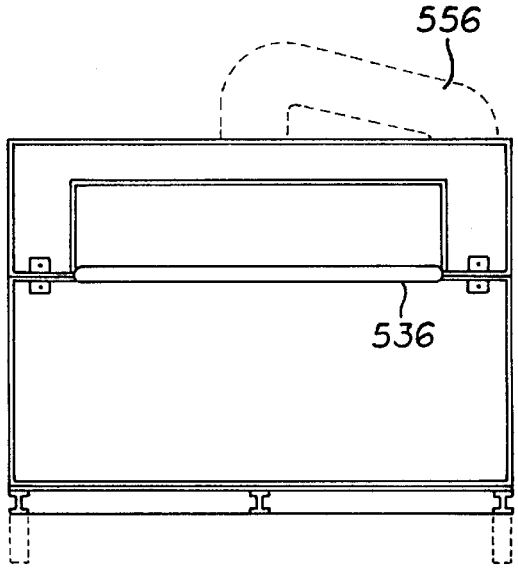
FIG. 45
FIG. 46
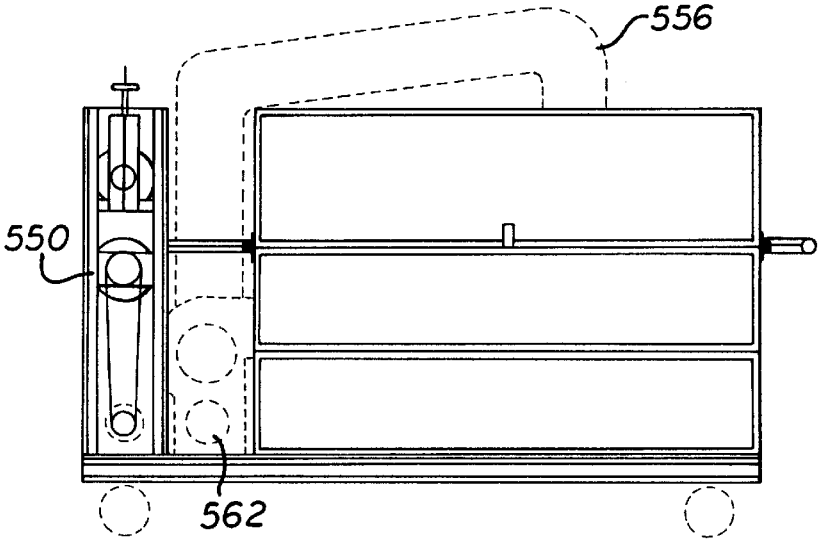

STRUCTURAL HONEYCOMB PANEL BUILDING SYSTEM

This application is a continuation of U.S. patent application Ser. No. 08/535,315, filed Sep. 27, 1995, now abandoned.

BACKGROUND OF THE INVENTION

1. Field of the Invention

The present invention relates to modular building systems, and, more particularly, to a modular structural member building system for use in erecting buildings, houses or other structures, including equipment and fabrication methods used in making modular structural members and used in combining modular structural members for building.

2. Description of the Related Art

Currently, there critically exists a need to provide an environmentally sensitive, economical, modular building system which can utilize the minimum of labor skills, provide for a low maintenance, provide for the conservative use of natural resources, and provide flexibility in style and design. However, until the present invention, there has not been provided a total integrated system of structural components that functions as a modular building system of floors, walls, ceilings, trusses, and roof members that can replace other materials conventionally used in frame buildings.

More particularly, there has not been a use of specific integrated materials that form a modular building system capable of eliminating the need to use a wide assortment of conventional materials, such as structural graded lumber, metal devices, seismic plywood panels, plastic non-biodegradable and chemical products. The supply of such conventional and natural building products is being diminished faster than the replenishment rate for these products, due largely to the increasing global demand for buildings and other structures. Hence, conventional building practices are currently inadequate for protecting the quality of life and preservation of natural resources on a global scale. Furthermore, until the present invention, there has not been provided a structural modular building system capable of resolving the interrelated difficulties of fabricating an integrated modular structural member to fulfill the structural and life/safety requirements of each specific material, said member being produced at low cost, having a light weight, being integrated from environmentally sound materials, and being flexibly combined with other modular components in to provide a modular building system.

Providing structural integrity with a consistent quality control of every member of the many components that make up a conventional building system presents difficulties due to the inconsistencies of the quality of graded lumber. Governing agencies, responsible for issuing building codes, have therefore implemented various codes to include additional structural connections and materials which in fact increased the cost, complexity, and difficulty of providing a modular structural member building system. Presently, no one has economically produced structural components with consistent structural integrity, flexibility of style and design, which are capable of being produced and installed in both domestic and international markets. The foregoing difficulty of providing a modular building system is compounded by the life/safety requirements of establishing a general and acceptance approval by the local, state, and national governing agencies; providing criteria, standards, inspections, and quality control of installations; providing performance specifications; and fulfilling the regulations and requirements of approved testing facilities.

Recognized approval ratings for structural members must be established and maintained for a particular modular system. Inspecting the quality of installed structural members is a third difficulty. The quality of structural members actually used in buildings must be ensured by fulfilling recognized approval ratings and inspection procedures in the interest of public safety. Providing sound design principles for structural members is still another difficulty. This entails the economical utilization of structural members in fabricating the various details of buildings while fulfilling all necessary building codes and architectural requirements. Conserving scarce materials and reducing costs while fabricating and using structural members is another difficulty. Environmental -preservation calls for the conservation of resources and materials while providing structural members in a modular building system while also overcoming the foregoing difficulties. The following discussion further illustrates the present need to adequately solve the foregoing interrelated difficulties of providing a low cost, environmentally sound modular structural member building system.

As indicated generally above, a major difficulty in providing modular structural members is ensuring the strength, or structural integrity, of the individual members or panels. A structural member, or sandwich panel, may be considered as a beam with regard to its structural integrity. A beam fails when it is does not have the required structural integrity or strength to safely support a given load condition. The structural integrity of a sandwich panel, or composite structural member, depends on a proper choice of materials for use in the member and on a meticulous control of the methods used to fabricate the materials into a finished structural member.

A sandwich panel, or composite structural member, is fabricated by bonding a core material to two adjacent skins or face sheets using a bonding agent. Thus, the structural integrity of a sandwich panel depends on factors that include the properties of the core material, the properties of the face sheet materials, the properties of the bonding agent, and on the methods used to join these materials. The dimensions of the panel and of the individual elements also impact the structural integrity. The problem of ensuring structural integrity is further compounded by the need to economically provide these materials at the job site in fabricated form.

Expandable honeycomb paper is one type of core material which has been used in fabricating sandwich panels. Such paper is provided in the form of an expandable honeycomb paper web which is expanded to provide a honeycomb core. Honeycomb paper is available from various vendors, including HEXACOMB HONEYCOMB CORPORATION, of Saint Louis, Missouri, and HEXEL, of Dublin, Calif. However, the literature available from these vendors does not appear to resolve the foregoing problems encountered in providing a low cost, environmentally sound, modular structural member building system.

From the standpoint of structural integrity, the sandwich panels or structural members are considered as beams. A beam must be capable of supporting various loads or forces between two or more given points of a building or structure. For a very general treatment of this subject refer to "Technical Service Bulletin H-4"0 published by HEXACOMB HONEYCOMB CORPORATION. However, this reference does not cover situations where structural performance of a panel is critical. In particular, the quality or integrity of the bond between the core and facing skin is not considered or discussed. Also, operational conditions which might adversely affect the behavior of certain grades of core or types of facings are not considered or discussed. The reference recommends separate investigation of these aspects of the problem, as well as actual testing of any panels fabricated for structural use. Thus, the bulletin does not solve any of the interrelated difficulties of providing structural integrity, quality control, approval, testing, inspection, sound design principles, conservation, or reduced costs in a modular structural member building system.

A reference published by HEXEL is entitled "Kraft Paper Honeycomb Commercial Grade—Structural", D.S. 1002 (1970). This reference provides specifications for the expandable honeycomb paper web itself. It does not discuss particular fabrication details or methods of making structural members having a honeycomb core. Similarly, this reference does not adequately address the interrelated difficulties of providing structural integrity, quality control, approval, testing, inspection, design principles, conservation, or reduced costs in structural sandwich panel buildings.

Honeycomb paper is available in either expanded form (i.e., as a "core") or unexpanded form (i.e., as an expandable "web") from vendors such as HEXEL or HEXACOMB. However, each form presents a unique difficulty with economically providing a structural honeycomb core member at a building site. These difficulties are not adequately addressed by either of the foregoing references. For expanded paper cores, shipping costs to the construction site are prohibitively high. This is because expanded cores have a large volume to weight ratio. For unexpanded paper webbing, shipping costs are relatively economical. However, local expansion requires facilities for expanding the paper to structural specifications. In particular, improper expansion of the paper web causes brittleness or other structural weakness in the resulting honeycomb paper core. An improperly expanded core must not be used in a structural member because the member would fail under designed load conditions. These difficulties of economically providing a structurally sound honeycomb core at a local building site have not been adequately resolved prior to the present invention. Accordingly, there is a need to provide for devices and systems for manufacturing modular structural honeycomb core members of relatively high quality and relatively low cost.

One of the present inventors, Robert L. Timbrook, secured U.S. Pat. No. 3,665,662 based on his early research into honeycomb core building panels. This patent is directed to a structural member for use in buildings, but it does not adequately resolve the interrelated difficulties indicated above. For example, there is no discussion of the expansion and transportation difficulties stemming from the use of a honeycomb paper core.

Similarly, the technical and commercial difficulties related to structural integrity, quality control, approval ratings, testing, inspection, sound design principles, and reduced costs are not adequately resolved by a reading of the Timbrook patent disclosure. The present disclosure reflects significant advances based on continued research and development on the part of the present inventors. Accordingly, U.S. Pat. No. 3,665,662 is incorporated by reference into the present patent application.

The International Conference of Building Officials (ICBO), through its subsidiary ICBO Evaluation Service (ICBO ES), Inc., evaluates and establishes acceptance criteria for sandwich panels. The ICBO ES is located in Whittier, Calif. A reference entitled "ACCEPTANCE CRITERIA FOR SANDWICH PANELS" was published by the ICBO ES in 1988, detailing the acceptance criteria as of that date. The criteria are used as a guideline which the ICBO ES requires independent testing authorities to follow when conducting evaluation reports of particular sandwich panel systems. Providers of sandwich panels or sandwich panel building systems must obtain an approved evaluation report from an independent testing authority (approved by the ICBO ES) on a yearly basis.

Evaluation criteria developed by the ICBO ES are based on requirements of the Uniform Building Code, the Uniform Mechanical Code, the Uniform Plumbing Code and related codes. Section 105 of the Uniform Building Code (UBC) is the basis for issuing evaluation reports on sandwich panels and other alternative building materials not specifically covered under the UBC.

Essentially, an evaluation report is designed to ensure that sandwich panels, or structural members, comply with the provisions of the Uniform Building Code and related codes. The ICBO ES may approve structural members if the proposed design is satisfactory and complies with other provisions of the code and that the materials and methods used are, for the purpose intended, at least the equivalent in the UBC in suitability, strength, effectiveness, fire resistance, durability, safety and sanitation. The acceptance criteria are issued to provide interested parties with guidelines on obtaining approved evaluation reports from independent authorities verifying that performance features of the codes are fulfilled.

Briefly, the sandwich panel acceptance criteria require that a proponent of a sandwich panel for evaluation fulfill many technical requirements. These requirements include: choosing panel test options; providing panel descriptions conforming to the panels under test; testing the panels (based on chosen test option) using a recognized testing agency or recognized independent observer; restrictions and miscellaneous criteria applying to actual panel uses; additional fabricator qualifications and procedures; panel identification procedures; and quality control monitoring through recognized inspection agencies. These acceptance criteria further illustrate the interrelated difficulties of providing a low cost, environmentally sound, structural member for use in a modular system for erecting buildings and other structures.

Hence, the acceptance criteria do not resolve the foregoing difficulties of providing modular structural members in an integrated building system. The criteria, if anything, appear to reflect the difficulties of providing structural members in an economical manner capable of successfully performing as an integrated building system. Presently, there has not been provided a structural honeycomb core building panel with the necessary combination of attributes to economically fulfill building requirements and to provide architectural design flexibility. These attributes include structural integrity, modularity, approved evaluation and testing, fabrication methods exhibiting quality control, inspection methods, adequate design principles, environmental conservation, low cost, and desirable building properties.

A modular, honeycomb core structural member has structural properties that vary greatly based on several factors. These factors include, but are not limited to: (1) the properties of the face sheet or skin materials; (2) the properties of the honeycomb core material; (3) the properties of the bonding agent used to join the core to the skins; (4) the fabrication method or process used to effectuate the adhesive bond between the core and skins; and (5) ambient conditions during fabrication. A honeycomb core structural member has other properties that also vary based on the choice of materials and method of fabricating the panels. These properties include, but are not limited to: (1) waterproofing; (2) fire resistance; (3) bug and vermin resistance; (4) fungiproofing; (5) seismic stressing; (6) sound absorption; (7) insulation against heat or cold; (8) design flexibility; and (9) durability or product life.

As is apparent from the foregoing discussion, the art is still without an economical, environmentally sound modular structural member for use in an integrated building system. Accordingly, it is an object of the present invention to provide an environmentally sensitive, economical, modular building system which can utilize the minimum of labor skills, provide for a low maintenance, provide for the conservative use of natural resources, and provide flexibility in style and design. Another object is to provide a total integrated system of structural components that functions as a modular building system of floors, walls, ceilings, trusses, and roof members that can replace other materials conventionally used in frame buildings.

SUMMARY OF THE INVENTION

Accordingly, there is herein provided an economical, environmentally sound modular structural member for use in an integrated building system. The present structural member building system provides an environmentally sensitive, economical, modular building system which can utilize the minimum of labor skills, provide for a low maintenance, provide for the conservative use of natural resources, and provide flexibility in style and design. Furthermore, the present modular structural building system comprises a total integrated system of structural components that functions as a modular building system of floors, walls, ceilings, trusses, and roof members that can replace other materials conventionally used in frame buildings.

Accordingly, the present invention comprises a complete system for fabricating modular structural members and for assembling them into a building, house, or other structure. The present invention provides a modular structural member building system which is economical and environmentally sound. The present invention solves the foregoing described difficulties and provides numerous features and advantageous in a structural member building system for erecting low cost housing and other structures. A brief description of the many particular features and advantages of the present structural member building system follows, but is by no means exhaustive. The reader will comprehend the synergistic effect and tremendous cumulative advantages provided by combining the numerous individual features of the present modular structural member building system in accord with the principles herein disclosed.

Accordingly, in one broad aspect the present invention provides a structural member comprising a first skin having a first surface and a second surface on opposing sides thereof; a second skin having a first surface and a second surface on opposing sides thereof; a honeycomb core comprising a plurality of honeycomb cells and having first and second sides corresponding to opposing sides of said honeycomb cells; a first adhesive layer bonding the first surface of the first skin to said first side of said honeycomb core; and a second adhesive layer bonding the first surface of said second skin to said second side of said honeycomb core; at least one of said first and second adhesive layers being substantially continuous over the first surface of the respective face skin and having a thickness of approximately five millimeters; wherein a structural member having substantial structural strength is provided.

In another broad aspect the present invention provides a structural member comprising a first face sheet having a first surface and a second surface on opposing sides thereof; a second face sheet having a first surface and a second surface on opposing sides thereof; a honeycomb core comprising a plurality of honeycomb cells; each of said plurality of honeycomb cells further comprising a plurality of web members, each of said web members further including a first edge and a second edge thereof; a first plurality of adhesive welds bonding each of said first web edges to said first surface of said first face sheet; and a second plurality of adhesive welds bonding each of said second web edges to said first surface of said second face sheet; each weld of said first and second plurality of adhesive welds comprising an approximate depth of at least 1/20 of an inch; wherein a building panel having significant resistance to creep between each of said face sheets and said honeycomb core is provided by said first plurality and said second plurality of adhesive welds.

In a still further broad aspect, the present invention provides a structural panel comprising a first face sheet having a first surface and a second surface on opposing sides thereof; a second face sheet having a first surface and a second surface on opposing sides thereof; a honeycomb core comprising a plurality of honeycomb cells and having first and second surfaces on opposing sides thereof; a first adhesive layer bonding the first surface of the first face sheet to said first surface of said honeycomb core; and a second adhesive layer bonding the first surface of said second face sheet to said second surface of said honeycomb core; each of said plurality of honeycomb cells including a first dimension directed along a first direction and a second dimension directed along a second direction; said first and said second directions being substantially orthogonal with respect to each other; the size of said first dimension exceeding the size of said second dimension in a substantial number of said plurality of honeycomb cells; wherein a structural building panel having augmented structural strength in a predetermined direction is provided by substantially aligning said second dimension of each of said honeycomb cells in said predetermined direction.

A still further broad aspect of the present invention provides for a structural panel comprising a first face sheet having a first surface and a second surface on opposing sides thereof; a second face sheet having a first surface and a second surface on opposing sides thereof; a honeycomb core comprising a web of honeycomb cells and having first and second surfaces on opposing sides thereof; a first adhesive layer bonding the first surface of the first face sheet to said first surface of said honeycomb core; and a second adhesive layer bonding the first surface of said second face sheet to said second surface of said honeycomb core; at least one of said first and second face sheets further comprising a water repellant gypsum sheet; wherein a structural building panel having substantial resistance to water is provided.

In a further broad aspect the present invention provides a structural panel assembly coating comprising at least one structural panel including an exposed surface thereon; an adjoining member, including an exposed surface thereon, disposed adjacent said panel, said exposed panel surface abutting said exposed surface of said adjoining member providing a seam therebetween; joint tape applied over said seam; and a continuous adhesive coating covering said joint tape and said exposed surfaces; wherein a water resistant surface is provided which is substantially waterproof and weather resistant and upon which finishes such as stucco or siding may be directly applied.

In a still further broad aspect the present invention provides an assembly of structural panels comprising a first structural panel portion including a first edge and a second edge; a second structural panel portion including a third edge and a fourth edge; and a third structural panel portion including at least a fifth edge; said first edge coupled to said third edge providing a joint having a seam running between said first and third edges; said second edge and said fourth edge being in substantially flush alignment at one end of said seam thereby providing a common edge; said fifth edge coupled to said common edge at an offset from said seam; wherein augmented strength in an assembly of structural panels is provided by offsetting the joint connections.

In a still further broad aspect the present invention provides a structural member box beam comprising: first, second, third and fourth structural members; said members each having opposing ends; each member being joined by a corner connection to one other member, respectively, at each of said opposing ends; said connections providing a box-shaped cross-section wherein each of said first second third and fourth structural members are connected at said opposing ends to two other of said structural members; wherein a structural panel box beam is provided for structural use as a beam or column during construction.

In another broad aspect the present invention provides a structural member compound beam comprising a plurality of structural members each having first and second opposing face surfaces and first and second opposing edges on the sides thereof; and at least one adhesive bond securing each of said plurality of structural members to at least one other of said plurality of structural members; said bond provided at a joint substantially connecting one of said first and second surfaces of a first of said plurality of structural members to one of said first and second surfaces of another of said plurality of structural members; wherein a compound beam is provided for structural use as a beam or column during construction.

In a still further broad aspect the present invention provides an expander system for expanding honeycomb paper, comprising enclosure providing a chamber having a feed opening and an exit opening; a heater disposed in and heating said chamber; a support rack for supporting honeycomb paper disposed within said chamber and spanning said chamber from said feed opening to said exit opening; and an expanding means for selectively moving said expandable honeycomb paper over said rack in said chamber, thereby expanding the paper; wherein expandable honeycomb paper is expanded into honeycomb core sheetstock and is thermally set to retain its shape.

In another broad aspect the present invention provides a stacking platen for aligning structural member components during fabrication in a lamination process employing a plurality of adhesive layers, said components including at least one structural core and first and second skins, comprising a substantially flat base plate providing a stacking surface; wheels mounted on said plate; and at least one stacking guide vertically mounted on said plate; said first skin having a first surface thereof positioned in contact with said base plate and having an edge thereof fixedly positioned on said plate with respect to said at least one stacking guide; said structural core having a first side thereof positioned in contact with an adhesive coated second surface of said first skin and having an edge thereof fixedly positioned with respect to said at least one stacking guide; said second skin having an adhesive coated first surface thereof positioned in contact with a second side of said structural core and having an edge thereof fixedly positioned with respect to said at least one stacking guide; said stacking guide adjustably positioned relative said plate for variously positioning said face skins and structural core relative each other during fabrication; wherein said components of at least one structural member are assembled in position relative each other during assembly and are held in position during curing of said adhesive.

In a further broad aspect the present invention provides a vacuum bag curing system for pressure curing structural members comprising a diaphragm shaped to cover a stack of structural members; a plurality of support tabs secured to said diaphragm; a support frame; a plurality of cords respectively and removably linking said support tabs to said support frame, thereby temporarily supporting said diaphragm; a flange providing a substantially airtight seal around an opening is said diaphragm; and a vacuum pump attached to said flange for evacuating air from said diaphragm; said cords being removed from said tabs during evacuation of said diaphragm to facilitate the collapse of said diaphragm over said stack of structural members during pressure curing thereof.

In a still further broad aspect the present invention provides a method of making at least one composite structural member comprising the steps of:

(A) providing a structural core comprising at least one core portion, said core portion further comprising a plurality of honeycomb cells, each of said plurality of cells further comprising a plurality of paper web members, said honeycomb core having a predetermined shape, predetermined thickness, and predetermined structural properties, and also having a first side and second side thereof corresponding to opposing ends of said web members;

(B) providing a first skin having a predetermined shape, predetermined thickness, and predetermined structural properties, said skin including a first and second surface;

(C) providing a second skin having a predetermined shape, predetermined thickness, and predetermined structural properties, said skin including a first and second surface;

(D) applying a first adhesive coating to a portion of said first surface of said first skin;

(F) selectively applying a catalyst to said first adhesive coating to substantially control the curing time thereof;

(H) adjoining a portion of said first side of said honeycomb core with a portion of the adhesive coated first surface of said first skin;

(I) applying a second adhesive coating to a portion of said first surface of said second skin;

(J) selectively applying said catalyst to said second adhesive coating to substantially control the curing time thereof;

(K) adjoining a portion of said second side of said honeycomb core with a portion of the adhesive coated first surface of said second skin; and (L) curing said adhesive coating at a predetermined pressure for a predetermined period of time;

wherein a composite structural member is produced which significantly resists creep and delamination between said first and second skin and said honeycomb core, thereby providing substantially desirable structural properties.

The numerous advantages of the present invention are due to careful choices of materials for use in the structural panels, careful choices of methods for manufacturing the panels, and careful choices of methods for assembling the panels in a building. Additionally, the present invention provides a range of devices and systems for manufacturing structural panels of high quality and relatively low cost.

The present invention advantageously provides for a modular structural member having an arbitrary shape and numerous desirable properties for building including substantial structural strength for bearing loads. The components of the present modular structural member are substantially provided of environmentally friendly, recycled materials and natural organic earth products which are non-toxic, odorless and long-lasting. The present modular structural member can advantageously have its size and capacity for withstanding the structural stresses of compression, tension and bending mathematically increased of decreased by selectively specifying the various parameters of the structural member components. The modularity of the present structural member advantageously provides a building material which is inexpensively and easily repaired when damaged.

The present invention provides a modular structural member that can be advantageously connected to other modular building components by bonds formed by surface contact with an adhesive. The present structural member is arbitrarily adapted to provide any combination of channels or protruding core tongues disposed along the edges thereof. This provides for a structural member that is conveniently assembled and combined with other structural members in a modular system using a tongue and groove connection. A still further aspect of the present invention provides a spline connector for advantageously combining modular structural members of arbitrary size of shape thereby providing a significantly strengthened structural joint between the members. The present modular structural member is easily and advantageously connected or fastened to other modular components, such as connecting posts or plates, which may comprise numerous materials including steel, wood, masonry, ceramic, marble, plastic, fabric, gunite, stucco or aluminum.

The present invention further provides a modular structural member that can be provided in arbitrary shapes, such as square, rectangular, tapered, curved and circular shaped members which can be free-standing or an integral part of a horizontal or vertical load bearing surface in combination with other structural members. The present modular structural member system is adapted to provide any style of architecture. The present modular structural member is advantageously employed as a vertical beam, a horizontal beam, an angled beam, a trapezoidal beam, a balanced beam or an unbalanced beam.

In another aspect, the present modular structural members are adapted to have variable spans, and are capable of carrying variable loads, such as uneven and eccentric loads. For example, the present modular structural member system can substantially resist current uplift loads and can resist wind loads in excess of 150 miles per hour. The present structural member system provides a seismic shear wall that is approximately 12 times more resistant to seismic stressing than is conventional stick framing. The present modular structural member system provides economical structural load bearing support in constructions up to three stories, or approximately 30 feet, in height.

The present modular structural member can be adapted to provide an acoustical barrier, a fire wall, a vacuum wall, a moisture barrier wall, a vermin resistant wall, a utility chase, or an HVAC (heating, ventilation, and air conditioning) plenum chase. The present modular structural member advantageously and integrally provides an electrical race track romex conduit or a gas line housing therein without the need of separate conduit or housing materials. The present modular structural member also provides a thermal wall substantially resisting heat loss and heat gain.

The present modular structural member can be formed to provide virtually any building feature. For example, a number of modular members may be adapted and interfit to form a spiral staircase of curved stringers, risers and treads without the need to use conventional structural elements therewith.

The present modular structural member is capable of fulfilling recognized ICBO ES approval and test requirements. The present structural member and building system are designed to provide for and pass straightforward inspection procedures. Unprecedented design principles are provided by the present structural member and modular building system, facilitating wide design flexibility and economic installation. The present modular structural member is easily repaired when damaged. The present structural member can resist sub-zero temperatures and has at least a 2-hour fire rating. The present modular structural member building system provides resistance to current uplift loads. The modular structural members are conveniently assembled prior to the installation of any doors or windows. The modular structural member is conveniently cut or shaped with basic craftsman's tools, for example, to obtain round duct openings or the like. The present modular structural panel building system eliminates the need for many typical products and methods of conventional construction such as waterproofing black exterior paper, wire mesh for stucco application, independent drywall installers, insulation blankets, plywood shear panels, seismic fasteners, structural clips, nailing hardware and ninety percent of wood products. The present modular structural member is light in weight and is easily installed by non-skilled labor. Each 4 foot by 8 foot panel weighs approximately 135 pounds.

Accordingly, the present invention provides an environmentally sensitive, economical, modular building system which can utilize the minimum of labor skills, provide for a low maintenance, provide for the conservative use of natural resources, and provide flexibility in style and design. The present invention provides a total integrated system of structural components that functions as a modular building system of floors, walls, ceilings, trusses, and roof members that can replace other materials conventionally used in frame buildings.

These and numerous other advantages of the present invention will become evident from th e following description of the preferred embodiment, taken together with the accompanying drawings.

DESCRIPTION OF THE DRAWINGS

Other objects, features and advantages of the invention will become readily apparent upon reference to the following detailed description when considered in conjunction with the accompanying drawings, in which like referenced numerals designate like parts throughout the figures thereof, and wherein:

FIG. 2 shows a rectangular, modular structural member building panel embodying principles of the present invention;

FIG. 3 shows a staggered assembly of modular structural members providing a structural surface for use in a building such as shown in typical house of FIG. 1 and embodying principles of the present invention;

FIG. 4 shows an end view of a modular structural member building panel as shown in FIG. 2;

FIG. 5*a* is a cutaway perspective view showing the details of a modular structural member building panel as shown in FIG. 2;

FIG. 5*d* is a top view of a top view of a honeycomb core as shown in FIG. 5*b*, illustrating a particular honeycomb cell size and cell orientation;

FIG. 5*e* is an expanded view of the honeycomb core as shown in FIG. 5*d;*

FIG. 5*f* is a top view of a honeycomb core showing a typical prefabricated cut-out opening disposed within said core;

FIG. 5*g* is a top view of a honeycomb core comprising a, plurality of core portions each having particular honeycomb cell dimensions and orientations;

FIG. 6 is a connection detail for a modular structural member exterior wall at a concrete slab;

FIG. 7 is a connection detail for a modular structural member exterior wall and floor at a concrete foundation with a ledge;

FIG. 8 is a connection detail for a modular structural member exterior wall corner with a corner post;

FIG. 9 is a connection detail for a modular structural member exterior wall corner with a corner post, for an alternate type of exterior corner;

FIG. 10 is a cross-sectional view of a splice joint connection detail of two modular structural members with a spline insert;

FIG. 11 is a connection detail showing alternative types of modular structural member exterior wall corners;

FIG. 12 is a connection detail for a modular structural member floor and wall at an intermediate or upper level floor;

FIG. 13 is a connection detail for a modular structural member roof to wall connection;

FIG. 14 is a connection detail for a modular structural member wall intersection;

FIG. 15 is a cross-sectional view of a tongue and groove joint connecting two modular structural members;

FIG. 16 is a connection detail for a modular structural member roof ridge;

FIG. 28 is a connection detail for an exterior door head or door jamb installed in a modular structural member wall, showing a stucco exterior finish;

FIG. 29 shows a window support frame in a modular structural member wall structure;

FIG. 30 is a connection detail for a box-type column comprising modular structural member sections;

FIG. 31 is a connection detail for a compound beam or column comprising modular structural member sections;

FIG. 32 is a connection detail for an exterior door head or door jamb in a modular structural member wall, showing a texture I11 exterior sheet;

FIG. 33 is a connection detail for a modular structural member wall showing an example of typical plumbing and fixture installation;

FIG. 34 is a connection detail for a modular structural member wall showing a typical plumbing chase installation;

FIG. 42 is a cutaway top view of the expander system of FIG. 40;

FIG. 43 is a left side view of the expander system of FIG. 40;

FIG. 44 is a front view of the expander system of FIG. 40;

FIG. 45 is a rear view of the expander system of FIG. 40;

FIG. 46 is a right side view of an expander system of FIG. 40;

DESCRIPTION OF THE PREFERRED EMBODIMENTS

Typical Building Made of Structural Panels

Figure 1:
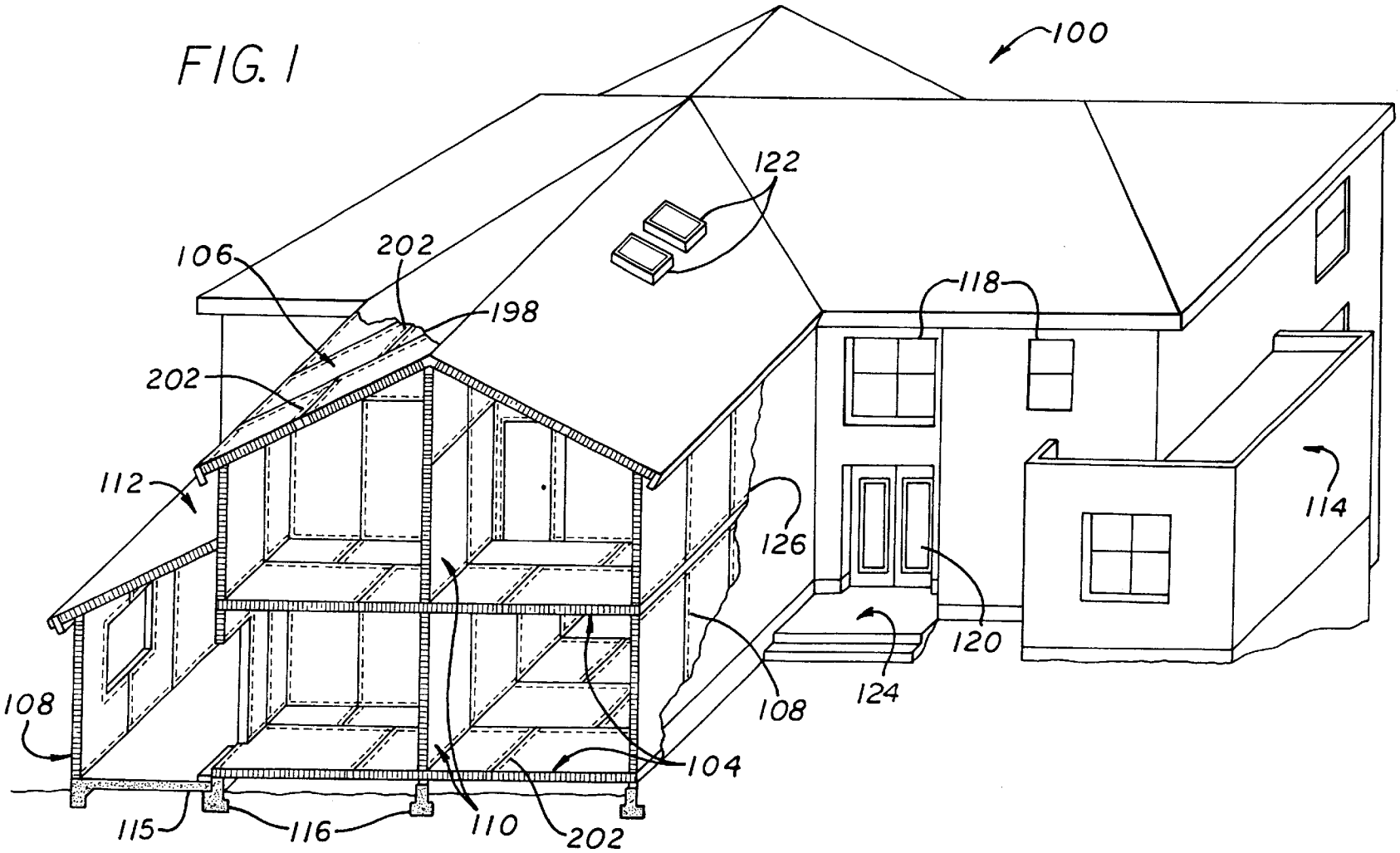
FIG. 1 is a cutaway perspective view of a typical house built entirely of prefabricated, modular structural members embodying principles of the present invention.

Referring to FIG. 1 a typical house 100 is built entirely of prefabricated modular structural members 102 (as best shown in FIGS. 2, 4, and 5*a*) in accord with the principles of the present invention. The present invention provides a total integrated system of structural components that functions as a modular building system of floors, walls, ceilings, trusses, and roof members that can replace other materials conventionally used in frame buildings. Virtually any type of building may be fabricated from the modular structural members 102 in a similar manner to that of typical house 100.

The house 100 of FIG. 1 illustrates generally that the floors 104, roof 106, exterior walls 108, interior walls 110, sub-roof 112, and parapet 114 are all fabricated using modular structural members 102. Construction of typical house 100 is upon a concrete slab 115, or upon a conventional foundation 116. Virtually all conventional features, such as windows 118, doors 120, and skylights 122 of typical house 100, are easily installed in accord with principles embodied in the present modular structural member building system. Other common building features, including but not limited to steps 124, stairways (not shown), or spiral staircases (not shown) are easily and economically provided using the present modular structural members 102. In short, virtually all features of a building or structure, such as typical house 100, are provided using the principles and methods embodied in the present modular structural members 102 and the present modular building system. Furthermore, the present system does not utilize conventional structural elements such as stick frame lumber or steel beams. Typical products and methods of conventional construction which are advantageously omitted from the present system include: waterproofing black exterior paper; wire mesh for stucco application; independent drywall installers; insulation blankets; plywood shear panels; seismic fasteners; structural clips; nailing hardware; and ninety percent (90%) of conventional wood products.

Exterior walls 108, and optionally other surfaces of typical house 100, in accord with one aspect of the present invention, are substantially waterproof prior to any application of exterior finishing materials. Conventional exterior finishes, such as stucco 126 or other conventional siding materials such as wood, brick, or stone (not shown), may be readily applied without having to first provide a waterproof paper and/or lathing treatment. The material and labor costs associated with installing such conventional exterior waterproof finishing treatments are thus, eliminated by the present invention. Other aspects, features and benefits of the present modular panel building system are disclosed in the following detailed description.

Modular Structural Member

Referring to FIGS. 2, 4, 5*a*, 5*b*, and 5*c*, in one aspect embodying principles of the present invention (best shown in FIG. 5*b*), a modular structural member 102 preferably comprises a first skin, or face sheet 128 having a first surface 130 and a second surface 132 on opposing sides thereof; a second skin, or face sheet 134 having a first surface 136 and a second surface 138 on opposing sides thereof; a honeycomb core 140 comprising a plurality of honeycomb cells 142 and having first and second sides 144, 146 corresponding to opposing sides of said honeycomb cells 142; a first adhesive layer 148 bonding the first surface 130 of the first skin 128 to said first side 144 of said honeycomb core 140; and a second adhesive layer 150 bonding the first surface 136 of said second skin 134 to said second side 146 of said honeycomb core 140. Preferably, at least one of said first 148 and second 150 adhesive layers is substantially continuous over the first surface of the respective face skin and has a thickness 152 of approximately five millimeters (5 mil), wherein a structural member 102 having substantial structural strength is provided for use in a modular structural building system.

Preferably, at least one of said first 128 and second 134 skins further comprises a water repellant gypsum sheet. Furthermore, said continuous adhesive layer is preferably disposed on said water repellant gypsum sheet thereby providing a modular structural member 102 having substantial resistance to water and moisture. In most cases, the water repellant gypsum sheet preferably comprises one-half (½) inch green board gypsum, such as is commonly available from various suppliers in the construction industry.

Similarly, at least one of said first 128 and second 134 skins may alternatively comprise wood, thereby providing a structural member having added strength for use in floors, roofs, and bearing walls of a structure. Preferably, said wood comprises five-eighths (⅝) inch exterior grade plywood. However, alternative wood skins may be provided, such as texture I11 sheeting.

Preferably, the honeycomb core 140 comprises a thermally treated, or thermo-set expandable paper web wherein the paper web is provided with a phenolic resin treatment as a predetermined percentage of the paper weight. The preferred paper web is additionally provided with fire retardant treatment. The foregoing treatments provide a modular structural member 102 having substantial structural strength as well as substantial resistance to damage from fire, water, molds or pests.

The first adhesive layer 148 and the second adhesive layer 150 preferably comprise a moisture-cured application of a one component adhesive. Furthermore, the one component adhesive is preferably a urethane based adhesive which cures based on ambient humidity or a water-fogged moisture application.

Alternatively, the first 148 and second 150 adhesive layer each comprise a cured two component application of epoxy resin and hardener. Preferably, said epoxy resin and hardener are Bisphenol A/Epichllorydring based materials. However, other two component compounds could also be used.

Referring to FIGS. 5*d* and 5*e*, each honeycomb cell of said plurality of honeycomb cells 142 includes a first dimension 154 directed along a first direction 156 of the modular structural member 102, and a second dimension 158 directed along a second direction 160 of the modular structural member 102. The first 156 and second 160 directions are substantially orthogonal with respect to each other, that is, they form a ninety degree angle to each other. A modular structural member 102 having augmented structural strength in a predetermined direction is advantageously provided by modifying one or both of the first 158 and second 160 cell dimensions during the thermal expansion of the core 140. As shown in FIG. 5*d*, the size of the first dimension 154 is substantially reduced in the first direction 156. Such a reduction increases the honeycomb cell density of the honeycomb core 140 along the first direction 156, thereby augmenting the structural strength of modular structural member 102 for bearing loads along the second direction 160.

Figure 5B:
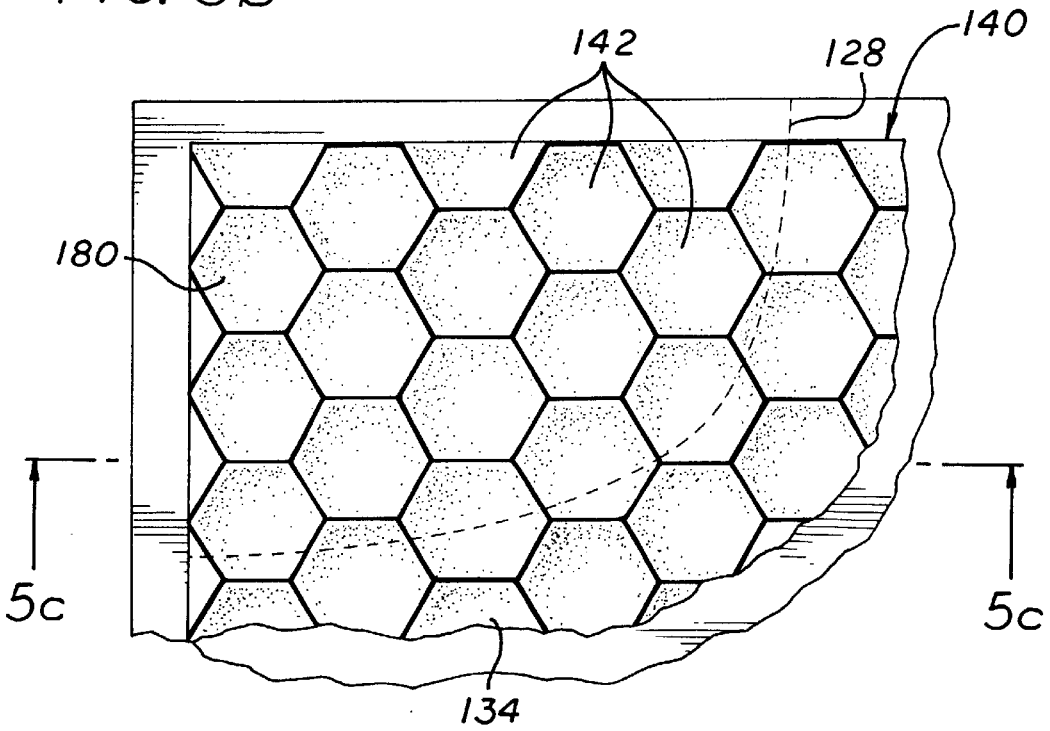
FIG. 5*b* is a cutaway top view showing the details of a typical honeycomb core of a modular structural member.
Figure 5C:
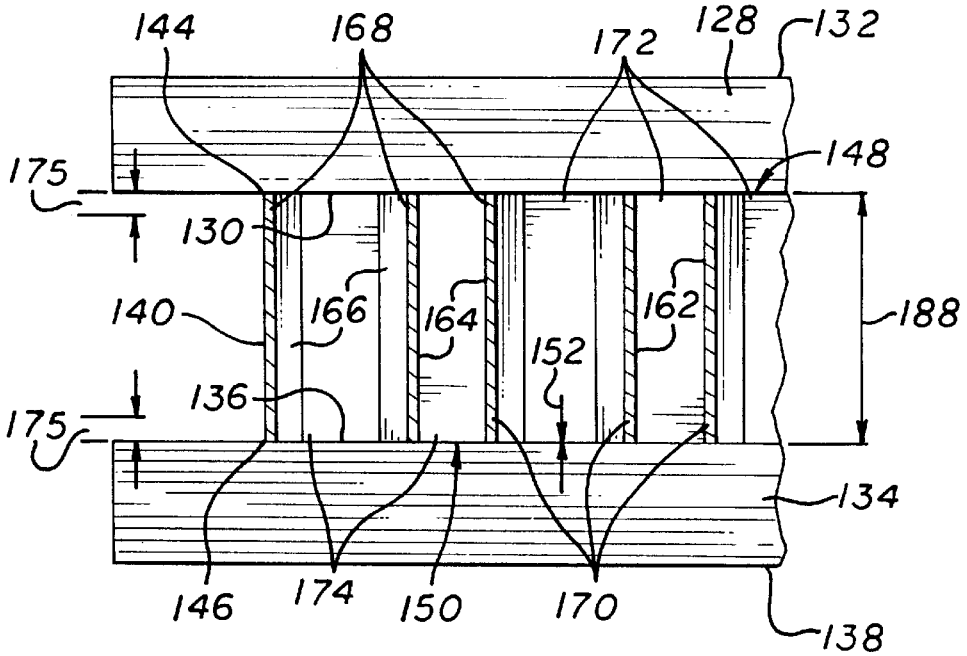
FIG. 5*c* is a, section view of a modular structural member, taken through the section c—c of FIG. 5*b;*

As is best illustrated in FIG. 5*c*, each of the honeycomb cells 142 preferably further comprises a plurality of web members 162, each of said web members 162 further including first and second opposing surfaces 164, 166 and first and second opposing ends 168, 170 thereof. The first adhesive layer 148 preferably further comprises a first plurality of adhesive welds 172 bonding a substantial portion of each of said first 164 and second 166 web surfaces to said first surface 130 of said first skin 128, with each of said adhesive welds 172 being disposed substantially at said first end 168 of each of said web members 162.

Similarly said second adhesive layer 150 preferably further comprises a second plurality of adhesive welds 174 bonding a substantial portion of each of said first 164 and second 166 web surfaces to said first surface 136 of said second skin 134, with each of said adhesive welds 174 being disposed substantially at said second end 170 of each said web members 162. Preferably, each weld of said first 172 and second 174 plurality of adhesive welds includes a fillet having an approximate depth 176 of at least one-sixteenth (1/16) of an inch, thereby providing a structural member having significant resistance to creep between each of said first 128 and second 134 face skins and said honeycomb core 140.

With reference to FIG. 2, an elongated portion of the structural core 140 preferably extends beyond the edges of the first 128 and second 134 skins providing a tongue 176 which engages and is adhesively bonded to channels 178, grooves and the like for installing the structural member 102 in a modular structural member building system. The channels 178 are provided in a region along chosen edges of a modular structural member 102. For example, a portion of the structural core 140 is removed from between the first 128 and second 134 skins thereby providing a channel 178. The rectangular modular structural member, or modular structural panel 102 shown in FIG. 2 includes channels 178 disposed along three edges thereof and the tongue 176 protruding from a fourth edge thereof. Each channel 178 engages and is adhesively bonded to the tongue 176, plates, posts, and the like for installing the structural member in a modular structural member building system, as described below in greater detail.

As shown in FIG. 5*b*, an insulation material 180 is disposed within a number of the honeycomb cells 142 in a finished structural member 102. The insulation material 180 preferably comprises pearlite in the form of relatively small pellets or granules. However, other materials with insulating characteristics may be used for the insulation material 180.

The details of the above-described modular structural member 102 may be modified in several ways in accord with principles embodied in the present invention. For example, the first skin 128 and the second skin 134 may comprise standard grade plywood of various thicknesses or may comprise gypsum wall board of various types or thicknesses. The honeycomb paper core 140 may also comprise various grades and thicknesses of expandable paper web. As discussed above, adhesive layers 148 and 150 may comprise a single component type adhesive or an epoxy type adhesive mixture.

As illustrated in FIG. 2, the modular structural building panels 102 are preferably manufactured to have a width 182 of four feet and a length 184 of eight, nine, or ten feet. However, other combinations of width and length dimensions may be provided. The wall panels 102 preferably have an overall thickness 186 of 4½ inches and comprise ½-inch thick water-resistant gypsum face sheets on a 3½-inch thick core 140 with a core thickness 188 which is best illustrated in FIG. 5*c*. Panels fabricated as floor and roof panels preferably have an overall thickness 186 of 6⅝ inches and have a 5½-inch thick core 140 with at least one face sheet 128 or 134 comprising ⅝-inch plywood.

Alternatively, different types of wooden sheeting or composite materials may be utilized as the skin or face material. For example, wooden face sheets having properties similar to those of plywood may be used. It should also be understood that the foregoing dimensions are offered by way of example and not of limitation. Accordingly, the dimensions and shapes of the modular structural members 102 may be specified as desired to satisfy particular structural installation requirements.

Referring particularly to FIGS. 2 and 4, the structural panel 102 preferably comprises an exposed tongue or core portion 176 extending beyond the edges of face sheets 128 and 134 along one side. The exposed tongue portion 176 preferably extends approximately 2 inches beyond the edge of the respective face sheets 128 and 134, and runs along the length 184 of panel 102. At some time prior to or during installation, the structural panel 102 is also adapted to provide channels 178 along the remaining three edges thereof. Each of these channels preferably has a depth of approximately 1½ to 3½ inches, depending on the type of coupling or connection required at each channel 178 within the modular building system. In some installations, it is preferable to provide a fourth 178 channel in the panel 102 rather than provide the tongue portion 176. The channels 178 may be configured to accept various connecting members during assembly of the modular structural members 102 in a modular building system. These members include the exposed tongue core portion 176 of other members 102, a portion of a spline 190 (FIGS. 3 and 10), or any of various filler plates or connection plates which may comprise metal or wooden members of various dimensions. For example, 2×4 or 4×4 plates and posts may be inserted into the various channels in accord with particular assembly detail requirements, as shown generally throughout the figures and discussed in greater detail below. During assembly, an adhesive material 196 is applied to the respective exposed surfaces of the first skin 128, the second skin 134, and the honeycomb core 140 in a channel 178 prior to insertion of a connecting member therein. Alternatively, the adhesive material 196 may be applied to the corresponding contact surface of the connecting member, such as tongue portion 176 or spline 190.

For purposes of handling the modular structural members 102 without damage, it is preferable to originally fabricate the honeycomb core 140 to substantially equal or slightly exceed the overall panel dimensions so that no channels 178 exist in the panel 102. As discussed in further detail below, during panel fabrication a glue line is used to mark the channel regions 178 so that excess honeycomb core material is disposed in, but not bonded to, the first 128 and second 134 skin in the respective channel regions 178. This helps prevent damage to the modular members 102 during shipping and handling. At some time prior to installation of a modular structural panel 102 in a building, excess core material may be removed from the respective channel regions 178 using a hammer, claw, or other suitable tool.

When fabricating modular structural members 102 for use in floors 104 and roofs 106, unexpanded honeycomb paper webbing 194 (FIG. 40) is obtained in continuous or ribbon form with the following specifications: thickness of 5½ inches; expanded width of approximately 4 feet, 2 inches (nominal); 99 pounds per ream standard paper weight (one ream equals 3,000 square feet); specified nominal cell size of 1⅜ inches measured across the flats of the cell; and an 18 percent resin impregnation content as a percentage of the finished paper weight. Modular structural members 102 fabricated for use in walls and similar building features employ an unexpanded paper webbing 194 with substantially the same specifications described above except the thickness 188 (FIG. 5B) is changed to 3½ inches.

However, the foregoing specifications may be changed to provide a finished modular structural member 102 having particular features for predetermined installation or design purposes. For example, the width of the core 140 can be changed to accommodate various building requirements. Virtually any available paper webbing 194 may be adapted for use in the present modular structural member 102, regardless of its specified cell size, thickness, paper weight, etc. For use in the present modular building system, it is also preferable to specify that the vendor provide further impregnation of the unexpanded honeycomb paper webbing 194 with fire-retardant additives.

The 18% phenolic resin impregnation provides the honeycomb core 140 with substantial waterproofing and moisture resistance. The resin impregnation also provides resistance to insects, termites and vermin while preventing the growth of fungus and other molds. The fire-retardant impregnation provides excellent resistance to combustion. The employment of such an impregnator with the honeycomb paper core 140 is complimented by the present fabrication method and choice of fabrication materials providing a modular structural member 102 with superior resistance to water, moisture, fungi, pests and fire. The unexpanded honeycomb paper webbing 194 may be made from recycled paper products, resulting in a substantial conservation of environmental resources for the present modular building system.

The honeycomb core 140 may be obtained in its full expanded form or, preferably, as the unexpanded honeycomb paper webbing 194 which can be economically shipped to a local building site or nearby location for expansion in the present expansion system (detailed below). When the honeycomb core 140 is obtained from vendors in its expanded form, the need to expand the webbing 194 locally is eliminated. However, the pre-expanded core alternative is cost prohibitive in most cases due to both high shipping costs and possible core breakage during shipping.

Referring again to FIGS. 2, 4, 5*a* and 5*b*, the first skin 128 or the second skin 134 preferably comprises water-resistant (green board) gypsum unless otherwise specified as plywood. Water-resistant gypsum sheets having standard specifications are available from several sources. Acceptable products include, but are not limited to: SHEETROCK® brand W/R water-resistant gypsum panels, Federal specification SS-L-30D type IV grade W or X class 2, ASTM designation C630, available from United States Gypsum of Chicago, Ill.; and Gyproc® Moisture-Guard gypsum board, Federal specification SS-L-30D type VII grade R&W class 2, ASTM designation C630, available from Domtar Gypsum.

The first skin 128 or the second skin 134 may also comprise ⅝-inch plywood, preferably of exterior grade. However, interior grade plywood may also be used. Such plywood is readily available as a staple item of construction. Plywood is provided in floor and roof panels primarily to provide added structural strength to these elements. Other wood sheeting products, such as texture I11 sheeting, can also be used in the present modular structural members 102.

Preferably, the adhesive material 196 comprises Mor-Ad® M-612 solvent free adhesive, produced by Morton International, Mor-Ad division, of Chicago, Ill. The Mor-Ad® adhesive is one of a family of Mor-Ad 600 series adhesives which are one-component, moisture-curing, non-volatile, urethane adhesives for laminating composite structural panels. Alternatively, a two-component epoxy adhesive may be used, such as STIC-BOND® EP-301, a Bisphenol A/Epichllorydrin based epoxy resin (and resin hardener), available from STIC-ADHESIVE Products Co., Inc., of Los Angeles, Calif. In each case, careful panel fabrication methods must be followed, as described in further detail below, to ensure the quality of the adhesive bond between the face skins 128, 134 and the honeycomb core 140.

Modular Structural Member Connection Details and Treatments

The present modular structural members 102 connect in a straightforward manner in a modular system to provide a structure such as the typical house 100. As stated above, virtually all structural features of the typical house 100 can be built using the modular members 102. The following discussion of connection details illustrates the principles embodied in the present modular structural building system for constructing buildings such as the typical house 100. Some general principles, connections, and procedures, common to most of the connection details, are discussed first.

Most modular connections are accomplished using Mor-Ad® M-612 adhesive to bond the modular members 102 and the other modular components together. Generally, the adhesive 196 applied to the less porous or more difficult-to-bond surface to be joined. The adhesive 196 may be applied using a roll coater at a film thickness of approximately 4 mils. Preferably, the adhesive 196 is applied using a bead applicator to extrude it onto the appropriate surface with a thickness of 6 mils. It would be foreseen that other adhesives may be used to bond the modular components based on the principles inherent in the present disclosure.

The adhesive 196 is preferably applied to the exposed surface of each skin 128, 134, and to the exposed surface of the core 140, in the channel region 178 to be joined. The resulting adhesive layer, weld, or connection 196 provides a tough, resilient connection of the modular components once the adhesive has cured. Tack nails or similar fasteners are preferably used, where appropriate, to facilitate proper curing of the adhesive connection 196 (FIG. 6).

The exterior walls 108, and possibly other critical weather surfaces, are preferably provided with a water-proofing treatment prior to the installation of conventional finishes. This aspect of the present invention conserves materials and reduces material and labor costs by eliminating the need for installing conventional water-proof paper on the walls. Additionally, the water-proof treatment, when applied to a wall of structural panels 102 incorporating the previously described water-resistant components, provides resistance to water and moisture which exceeds that of many conventional types of construction.

Referring to FIG. 1, the exterior wall 108 includes seams at all panel connection points, such as at tongue and groove joints 198. The seams are covered using conventional exterior joint tape, or mesh 200 (FIG. 6). A continuous layer of adhesive is then applied to the entire exterior wall surface, preferably using a roll coater applicator. This provides a water-proof adhesive coating for the wall. The thickness of the coating is preferably 2–4 mils. conventional finishes, such as stucco or wooden siding, may be applied directly over the water-proof treatment. Two types of joints, or connections, are generally used to connect structural panels 102 to each other. The tongue and groove joints 198 are used extensively in walls, floors, roofs, and other structures. As shown in FIGS. 1 and 3, splice joints 202 are used in floors, roofs, and other surfaces where added strength is required.

FIG. 15 shows a tongue and groove joint, or connection 198 between a first structural honeycomb core building panel 102-1 and a second structural honeycomb core building panel 102-2. Whenever two panels 102 are to be connected along their long edges, whether flush or staggered, it is preferable to make the connection using a tongue and groove joint 198. However, a design may call for a splice joint 202 along the panel lengths to provide added strength in the joint when necessary.

The tongue and groove joint 198 usually comprises an exposed core portion 204 of the first panel 102-1 engaged in and bonded to the third channel 178-3 of the second panel 102-2 by the adhesive layer 196. The adhesive 196 is applied as a bead to the exposed surface of the face sheets in the third channel 178-3 prior to the connection. As may be readily appreciated, the tongue and groove joints 202 can be formed in any channel 178 of the panel 102.

FIG. 10 shows a splice joint, or connection 202 between a first structural honeycomb core building panel 102-1 and a second structural honeycomb core building panel 102-2. FIG. 1 further illustrates typical splice joints 202 in the floor 104 and the roof 106. Whenever two panels 102 are to be connected along their short edges, whether flush or staggered, it is preferable to make the connection using a splice joint 202.

The splice joint 202 usually comprises a spline 190 engaged between and bonded to respective short channels 178-1, 178-2 of the structural panels 102-1, 102-2 by the adhesive layer 196. The adhesive 196 is applied as a bead to the exposed surface of the face sheets in the channels 178-1, 178-2 prior to the connection. Additionally, splice joints 202 may be formed along a long channel 178-3 of the of structural panels 102 (FIG. 2).

Dimensions of the spline 190 are adapted to the dimensions of the channels 178 of the structural panels 102 which are to be joined. Spline edge sheets 206 preferably comprise standard ½-inch plywood, however, different thicknesses may be used. A spline paper core is comprised of an expanded honeycomb paper core such as the core 140 discussed supra with a thickness adapted to the thickness of the structural panels 102 to be joined.

For structural panels 102 having a 6⅛-inch thickness, the thickness of spline paper core 208 is preferably 4½ inches. For structural panels 102 having a 4-inch thickness, the thickness of spline paper core 208 is preferably 2½ inches. In general, the overall thickness of the spline paper core is designed to be equal to the thickness of the expanded honeycomb paper core 140 in the panels to be joined.

The plates, sills, posts, filler plates, and miscellaneous other members used in the various connection details which follow preferably comprise a construction grade lumber. Having established the general principles, connection details, and procedures, the discussion proceeds to more particular connection details.

FIG. 6 illustrates a connection detail for the exterior wall 108 at the concrete slab 115. A sill 210 is provided atop the slab 115 in a conventional manner. An anchor bolt 212 and a nut 214 secure the sill 210 to the concrete slab 115.

The exterior wall 108 comprises interlocking structural honeycomb core building panels 102, as shown in FIG. 1. The panels 102 may be connected to form the exterior wall 108, or a portion thereof, prior to installation on the sill 210. Alternatively, the panels 102 may be individually installed on the sill 210 and connected with each other at the time of installation.

The sill 210 engages the second channel 178-2 (FIG. 2) at the lower end of each structural honeycomb core building panel 102 contained in the exterior wall 108. A bead of adhesive is applied to the exposed surfaces of the face sheets in the second channel 178-2 just prior to installation of the panel 102 on the sill 210. The adhesive layer 196 is thus formed in the completed connection. Conventional tack nails 216 are driven through the panels 102 into the sill 210, to stabilize the connection while curing occurs.

A plaster weep screed 218 is installed in a conventional manner at the base of the exterior wall 108. The exterior joint tape 200 is applied over the top edge of the plaster weep screed 218 in conventional fashion. The exterior wall 108 is given a water-proof adhesive treatment as described above, and then stucco 126, or other finish, is applied in a conventional manner.

FIG. 7 illustrates a connection detail of an exterior wall 108 and a floor 104 at a concrete foundation 220 with a ledge 222. The exterior wall 108 is connected to the sill 210 in the same manner as previously described for FIG. 6. A termite shield 224 is installed on the ledge portion 222 of the concrete foundation 220, and a ledge plate 226 is bolted in place above the ledge portion 222. An adhesive bead is applied to the channel portion of the floor 104 just prior to its installation on the ledge plate 226. The adhesive layer 196 is thus formed in the completed connection.

FIG. 8 illustrates a connection detail of an exterior wall corner including a corner post 228. A first exterior wall 108-1 is erected and a channel 178 is provided at its edge to accommodate the corner post 228, which comprises a four-by-four lumber post. An adhesive bead is applied to the exposed face surfaces in the channel region 178 and the corner post 228 is installed in the edge channel 178 of the first wall 108-1. Tack nails 216 are then inserted into the corner post 228. Next, an adhesive bead is applied to a gypsum corner end strip 230 and the strip 230 is tack-nailed to the corner post 228.

An adhesive bead is applied down the interior edge of first exterior wall 108-1 and a wall connection plate 232 is positioned over the adhesive. Next, long tack nails 234 are inserted through the wall connection plate 232 into the corner post 228. The wall connection plate 232 preferably comprises standard 2×4 lumber. Thereafter, adhesive beads are applied to the exposed surfaces of the face sheets in the channel region at the end of a second exterior wall 108-2 which is then installed on the wall connection plate 232. The above-described adhesive beads form adhesive layers 196 in the finished connection.

The exterior joints are covered with exterior joint tape 200, and the interior corner is treated as a conventional interior compound joint 236. The exterior wall surfaces are treated for water-proofing and covered with stucco 126 or other conventional finish.

FIG. 9 illustrates a connection detail of an alternative type of exterior wall corner utilizing a corner post 228. The connection and construction details are similar to those discussed with reference to FIG. 8, except that the acute corner receives an exterior finish and the obtuse corner is treated as a conventional interior compound joint 236.

FIG. 11 illustrates a connection detail for two types of exterior wall corners which do not utilize a corner post. The connection details are substantially the same for each corner as those described in FIG. 8, with the corner post 228 being replaced by wall end filler plates 238 which preferably comprises standard 2×4 lumber.

FIG. 12 illustrates a connection detail for floor to wall connections at an intermediate or upper level floor. A wall top plate 240 is bonded in the upper channel of the lower floor exterior wall 108. The floor 104 is bonded atop the wall top plate 240. An intermediate floor end filler plate 242 is bonded in the edge channel of the floor 104. A gypsum intermediate floor edge strip 244 is bonded to the end of the floor 104. An intermediate floor plate 246 is then bonded to the top edge of the floor 104. Finally, an upper exterior wall 108 is bonded to the intermediate floor plate 246.

FIG. 13 illustrates a connection detail for a structural panel roof to wall connection. The wall 108 includes an angled roof connection plate 248 bonded in its upper channel. The roof 106 is bonded and tack nailed atop the angled roof connection plate 248, and a gypsum roof connection edge strip 250 is bonded to the exposed portion of angled roof connection plate 248.

FIG. 14 illustrates a connection detail for a structural panel wall intersection. The wall connection plate 232 is bonded to the first wall 108 at the desired connection point and secured in place during curing by long tack nail 234. The second wall 110 is fitted around the wall connection plate 232 and adhered to the first wall 108 and to the wall connection plate 232 as shown.

FIG. 16 illustrates a connection detail for a structural panel roof ridge without a ridge beam. Roof ridge plates 252 are bonded into the channels at the ridge of the roof portions 106. First, the adhesive is applied to a ridge contact surface 254 of one of the roof ridge plate 252. Thereafter, the roof ridge plates 254 are made to contact each other when the roof portions 106 are brought together. The roof ridge plates 252 are then tack nailed through the plywood face sheets and through each other. Finally, roof ridge edge strips 256 are bonded over the upper exposed surfaces of the roof ridge plates 252.

Figure 17:
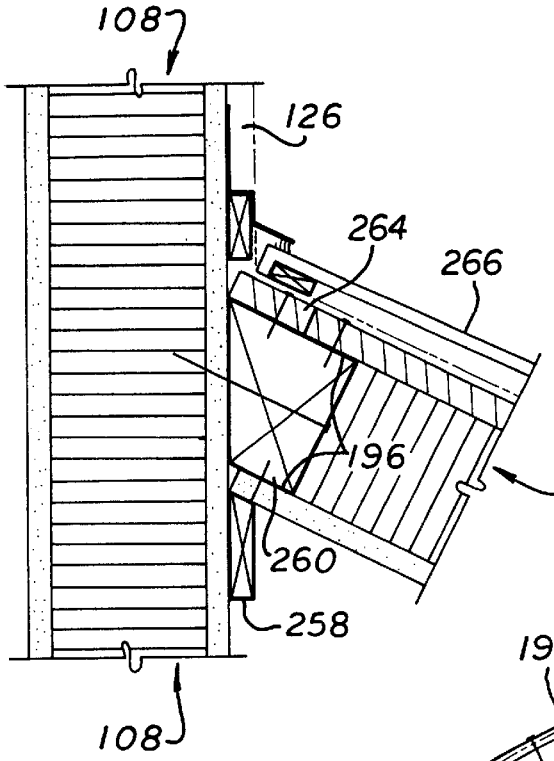
FIG. 17 is a connection detail for a modular structural member sub-roof to wall connection.

FIG. 17 illustrates a connection detail for a structural panel sub-roof to wall connection. A lower positioning strip 258 is bonded to an exterior wall 108. A shaped sub-roof connection plate 260 is bonded in the upper channel of a sub-roof 262. The sub-roof 262 is bonded to the exterior wall 108 at the sub-roof connection plate 260, just above the lower positioning strip 258. A sub-roof edge strip 264 is bonded to the exposed surface of the sub-roof connection plate 260. A conventional roof finish 266, such as the tile roof shown, is installed on the upper surface of the sub-roof 262. Finally, stucco 126 or other finish is installed on the exterior wall 108.

Figure 18:
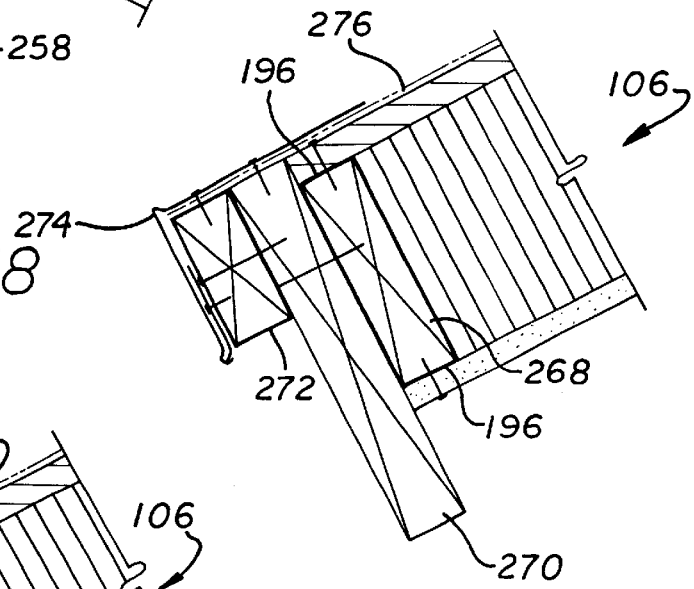
FIG. 18 is a connection detail for a modular structural member overhanging eave.

FIG. 18 is a connection detail for a structural panel overhanging eave. A roof end filler plate 268 is bonded into the lower end channel of the roof 108, where the roof 106 overhangs the building. A facia 270, preferably comprising 2×8 or 2×10 lumber, is bonded to the end filler plate 268 at the roof edge. A short facia 272 may be bonded to the facia 270 if desired. Additionally, a conventional overhanging eave flashing 274 may be nailed or bonded in place over conventional water proofing paper 276.

Figure 19:
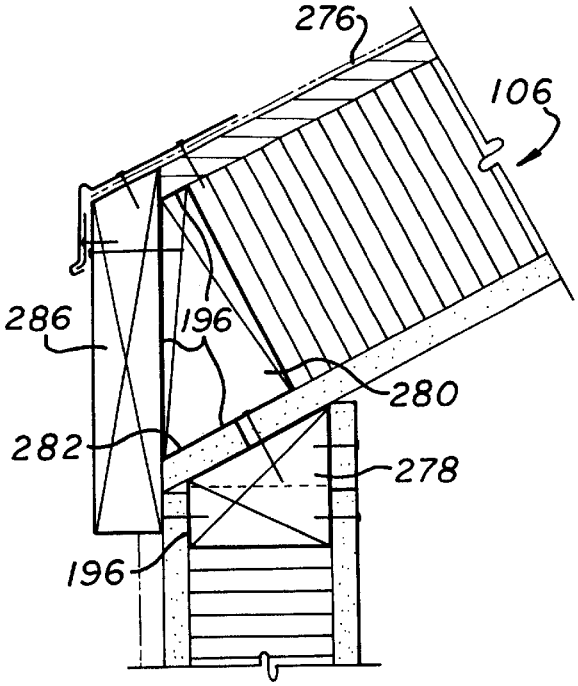
FIG. 19 is a connection detail for a modular structural member flush eave.

FIG. 19 is a connection detail for a structural panel flush eave. An angled roof brace member 278 is bonded in the upper channel of the exterior wall 108. An angled roof end filler plate 280 is bonded to the lower end channel of the roof 106, where the roof connects flush to the exterior wall 108. A gypsum edge strip 282 is bonded to the exposed lower portion of the angled roof end filler plate 280. The edge of the roof 106 is then bonded to the angled roof brace member 278 at the top of the exterior wall 108. A gypsum edge strip 284 is bonded to the remaining exposed surface of the angled roof brace member 278. A flush eave facia 286 is then bonded to both the angled roof end filler plate 280 at its exposed surface and to the upper surface along the exterior wall 108. Thereafter, water proofing paper 276 is applied and a conventional flush eave flashing 288 is bonded or nailed in place.

Figure 20:
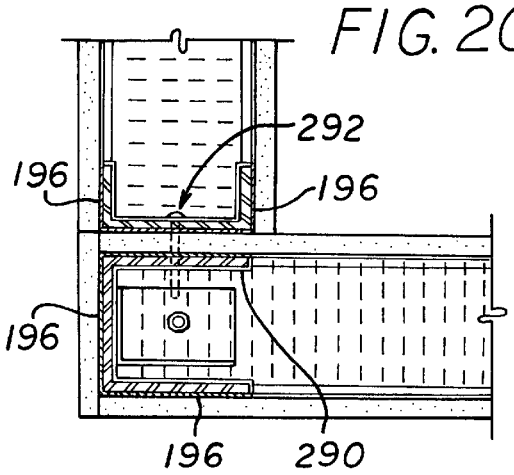
FIG. 20 is a connection detail for a modular structural member exterior wall corner with a metal-channel corner post, a metal-channel plate, and a metal anchor.

FIG. 20 is a cross-sectional downward view of a wall corner including a metal channel 290 rather than a wood member. Adhesive specifications are somewhat different because of the metal-paper-drywall arrangement. More specifically, the adhesive is preferably applied with a bead applicator rather than a roll applicator to provide a thicker application of the adhesive. A tacking nail 292 is shown through the metal channel 290.

Figure 21:
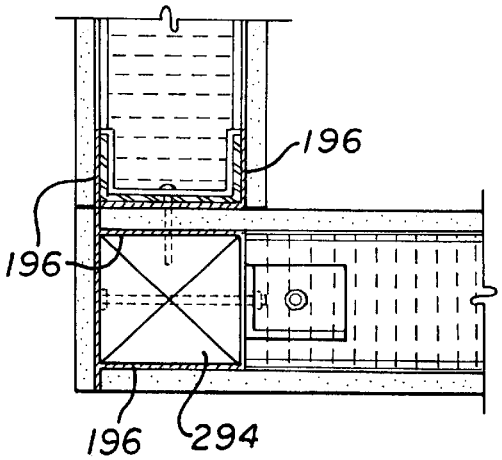
FIG. 21 is a connection detail for a modular structural member exterior wall corner with a metal-channel plate, solid post, and metal anchor.

FIG. 21 shows a connection detail with both metal and wood channels including a 4×4 corner post 294 of a typical wall.

Figure 22:
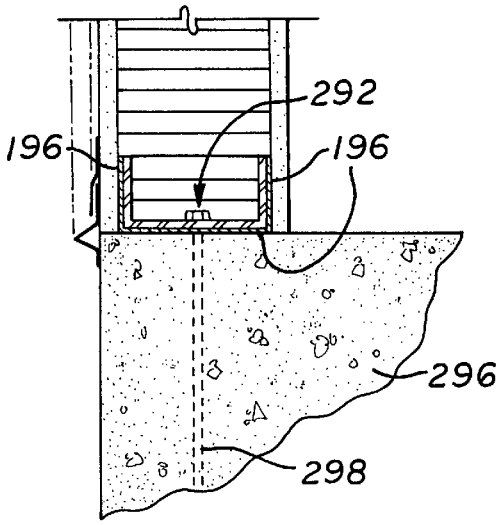
FIG. 22 is a connection detail for a modular structural member exterior wall at a concrete slab with a metal-channel sill.

FIG. 22 illustrates a cross-sectional sideview of the metal channel 290 secured to a concrete foundation 296 with an anchor bolt 298.

Figure 23:
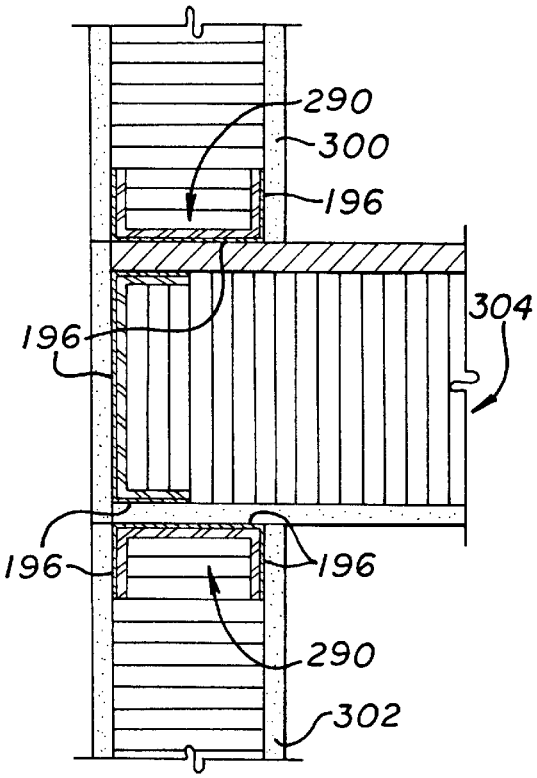
FIG. 23 is a connection detail for a modular structural member floor and wall at an intermediate or upper level floor with metal-channel plates.

FIG. 23 shows a cross-sectional sideview of an upper wall portion 300, lower wall portion 302 and floor portion 304 employing metal channels 290.

Figure 24A:
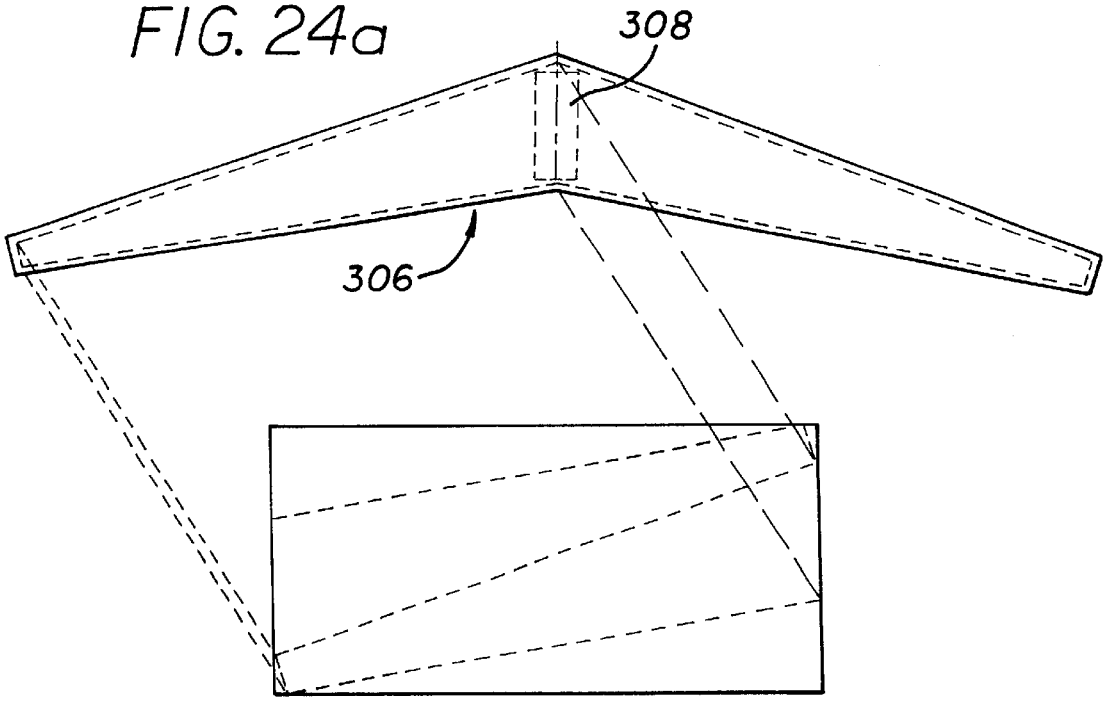
FIG. 24 is a roof truss comprising modular structural members.
Figure 24B:
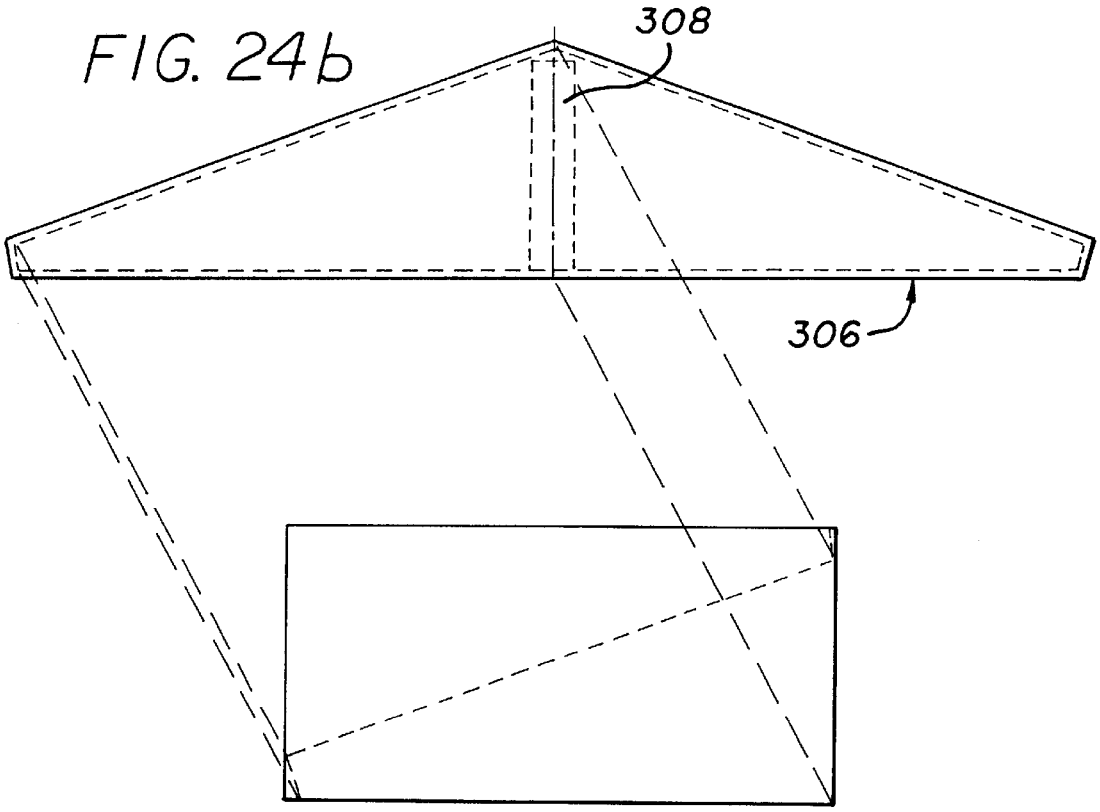

FIG. 24 shows a cross-sectional sideview of a ceiling truss 306 comprising modular structural members as provided in the present disclosure including splines 308.

Figure 25:
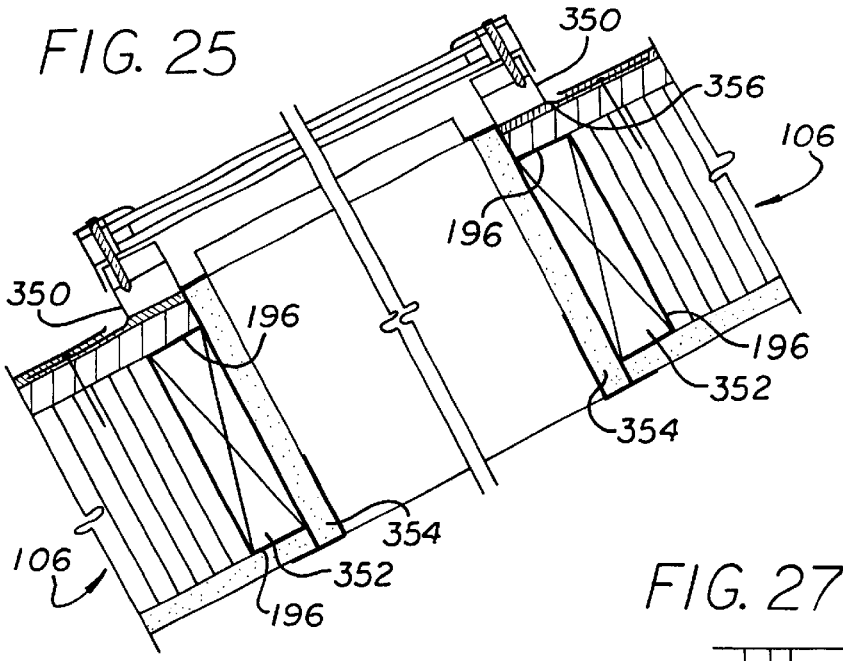
FIG. 25 is a connection detail for a skylight installed in a modular structural member roof.

FIG. 25 illustrates a connection detail for a skylight installed in a structural panel roof. An opening is first provided in the roof 106 suitable for receiving conventional skylight mounting frame 350. Skylight filler plates 352 are bonded into channels which are formed around the perimeter of the opening in the roof 106. Gypsum skylight interior edge strips 354 are bonded in place around the perimeter. Finally, the conventional skylight mounting frame 350 is adhesively bonded in place over the opening and a weather sealant 356 is provided in a conventional manner.

Figure 26:
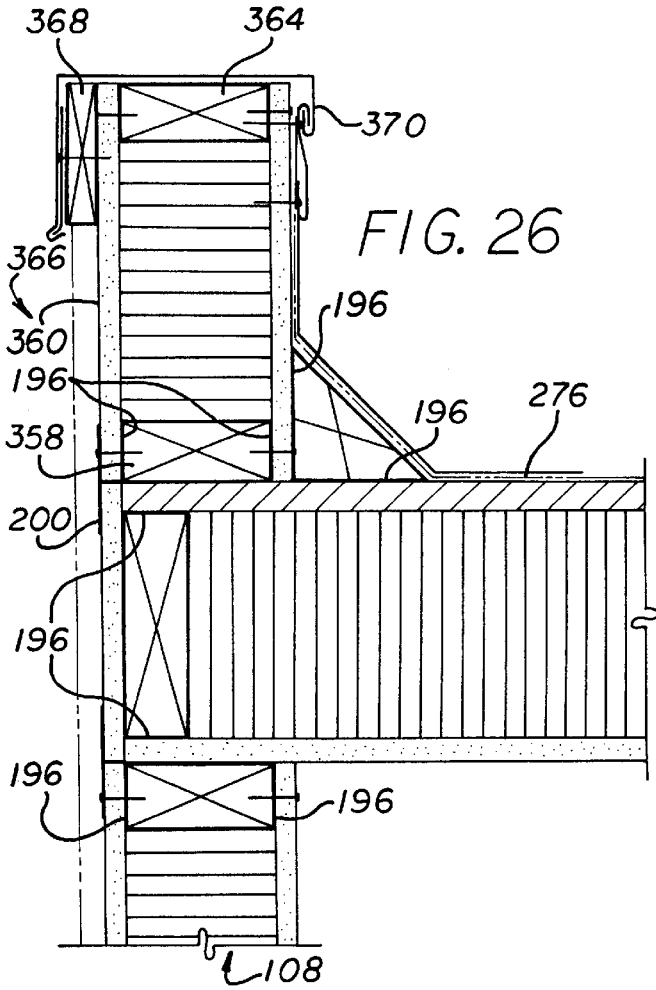
FIG. 26 is a connection detail for a modular structural member wall to parapet connection.

FIG. 26 is a connection detail for a structural panel wall to parapet connection at an upper floor. A parapet floor plate 358 is bonded to the floor where the parapet is to be built. A parapet panel section 360 is bonded to the parapet floor plate 358 in its lower channel. An angled parapet brace member 362 is bonded in the lower edges of the corner formed between the floor and the parapet panel section 360. A parapet top filler plate 364 is bonded in the upper channel of the parapet panel section 360. Water-proofing paper 276 and conventional weather finish are installed on the interior surface of parapet 366. A parapet furring strip 368 and a conventional parapet flashing 370 are bonded and nailed, respectively, to the top portion of the parapet panel section 360. The exterior of the parapet 358 receives joint tape 200, water-proofing treatment, and a conventional finish such as stucco 126.

Figure 27:
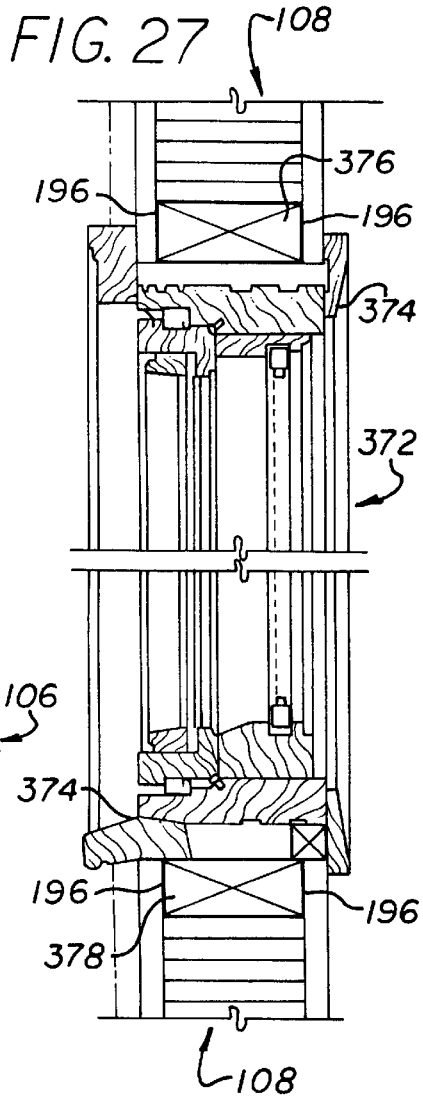
FIG. 27 is a connection detail for a double hung window installed in a modular structural member wall, showing a stucco exterior finish.

FIG. 27 is a connection detail for a double hung window installed in a structural panel wall, showing a stucco exterior finish. A conventional window assembly 372 includes a conventional window mounting frame 374. An opening is provided in the wall suitable for accommodating the window assembly 372. A window head plate 376, a window sill plate 378, and window jamb plates (not shown) are bonded in channels provided around the perimeter of the opening. The window is installed in a substantially conventional fashion, except that adhesive is applied to all surfaces of the wall, head plate, sill plate, or window jambs which will be in contact with the installed window frame. The adhesive forms adhesive layer 196, portions of which are shown, bonding the window securely in place.

FIG. 28 illustrates a connection detail for an exterior door installed in a structural panel wall, showing a stucco exterior finish. A suitable opening is provided in the wall to accommodate a conventional door frame 380. A door head plate 382 and door jambs (not shown) are bonded in channels formed around the perimeter of the opening in the wall. The door frame 380 is installed in a substantially conventional fashion, except that adhesive is applied to all surfaces of the wall, head plate, floor, or door jambs which will be in contact with the installed door frame. The adhesive forms adhesive layer 196, portions of which are shown, bonding the door frame securely in place. Interior and exterior door molding, 384 and 386, are bonded in place around the door frame 380. A door 388 is installed in the frame 380. Interior doors are installed in substantially the same fashion.

FIG. 29 shows a window support frame spanning several panels in a structural honeycomb core panel wall structure. In this case, a perimeter 390 may be provided either by pre-cutting the panels 102 or by cutting an opening in the finished wall 108. Hidden lines show the wall top plate 240, the sill 210, and tongue and groove joints 198 used to form the wall 108. The window head plate 376, the window sill plate 378, and window jamb plates 392 are bonded in channels provided around the perimeter 390. The foregoing components are shown by hidden lines. A window may be bonded into the support frame in a manner similar to that discussed for FIG. 27.

FIG. 32 is a connection detail for an exterior door installed in a structural panel wall, showing a plywood exterior sheet. The installation and details are substantially similar to those described above with reference to FIG. 28.

FIG. 33 is a connection detail for a structural panel wall showing an example of installed plumbing and fixtures. Typical fixture 394 is shown as a tub. Water supply pipes 396 are preferably installed in a chase, such as shown most clearly in FIG. 34. The remaining section details show a conventional fixture installation 398.

FIG. 34 is a connection detail for a structural panel wall showing a plumbing chase inserted in a structural honeycomb core panel wall. Four wall connection plates 232 are shown bonding a plumbing chase 400 to wall panels on either side of the chase 400. Alternatively, the chase 400 can be bonded in place using only one wall connection plate 232 on each side of the chase 400. The chase 400 is a short section which does not include a honeycomb paper core between its face sheets.

The chase 400 accommodates conventional plumbing components. FIG. 34 shows water service pipes 402 and a waste, drain, or vent pipe 404 as examples. Insulation or packing 406 may also be installed in the chase 400.

Figure 35:
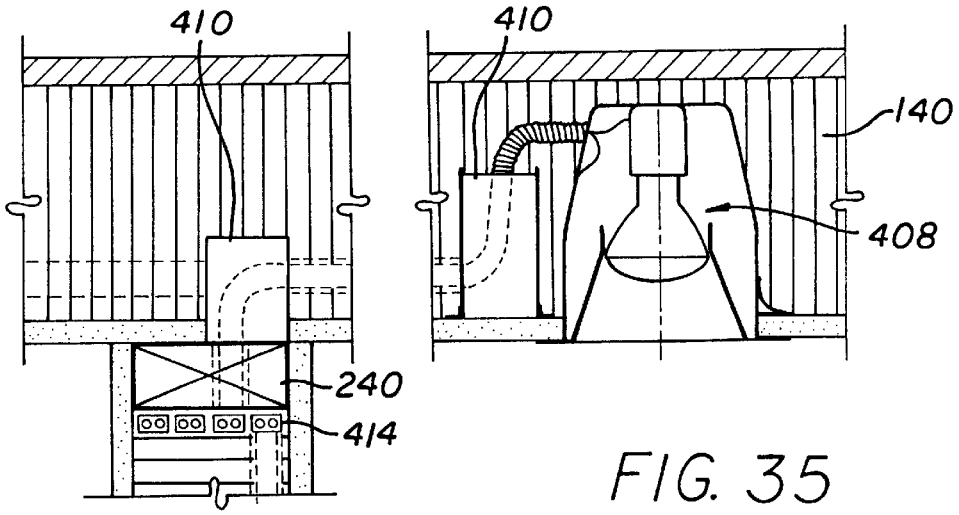
FIG. 35 is a connection detail of a typical lighting fixture and electrical wiring installation in a modular structural member wall and ceiling.

FIG. 35 shows an example of a lighting fixture and electrical wiring installed in a structural honeycomb core panel wall and ceiling. A conventional recessed lighting fixture 408 is bonded into an appropriate hole provided in the ceiling. Conventional junction (or distribution) boxes 410, of various types are also bonded into appropriate holes provided in the structural panels 102.

Wiring holes 412 are punched or drilled, as required, through the honeycomb paper core 140. An electrical race 414 provides a small space between the top of the honeycomb paper core 140 and the bottom of the wall top plate 240 in walls to accommodate wiring. Conventional wiring, preferably Rommex® insulated wire, may then be routed through the races 414 and the wiring conduits 412 to link the distribution boxes 410 to fixtures.

Of course, the above construction procedures may be substantially implemented according to conventional wiring practices. For example, wiring 416 is placed in the electrical race 414 before wall top plate 240 is installed on the top of the wall. Thus, the wiring 416 is pulled, fed, or otherwise installed in the building as an integral step of the detail connection sequence, using conventional procedures as they may apply.

Figure 36:
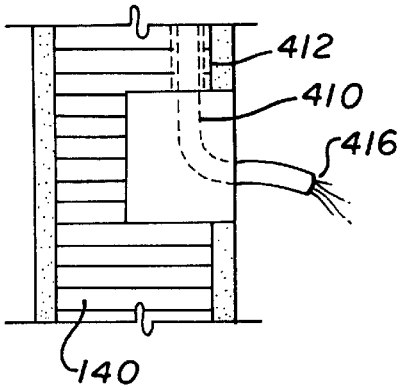
FIG. 36 is a connection detail of a typical ceiling mounted lighting fixture installation in a modular structural member ceiling.
Figure 36:
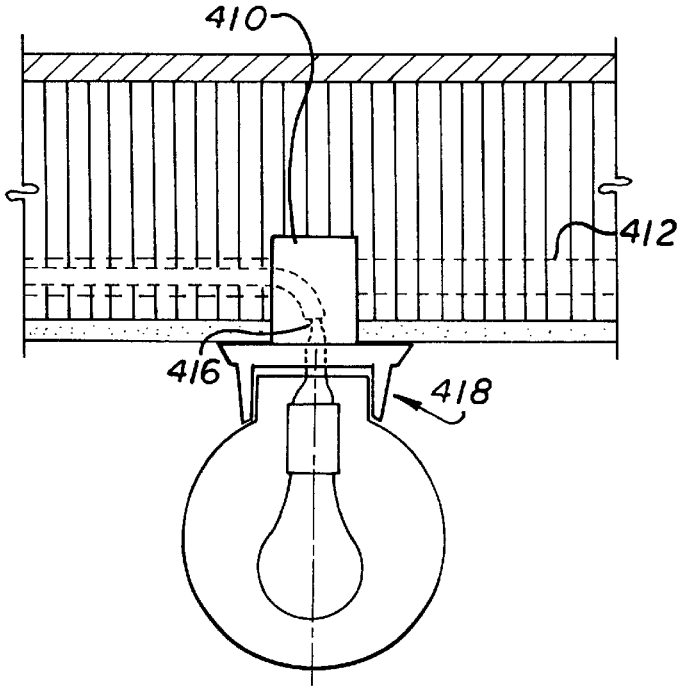

FIG. 36 shows an example of a conventional ceiling mounted lighting fixture 418 installed in a structural honeycomb core panel ceiling. Electrical wiring 416, the mounting/junction box 410 and wiring conduits 412 are shown in accord with the preceding discussion.

It should be understood that the foregoing examples and connection details are by no means exhaustive and are merely intended to illustrate how the features of a building such as the typical house 100 can be implemented using the principles of the present structural building panel 102 and panel building system. Other connections and uses for the structural honeycomb core building panels 102 are contemplated as being within the scope of the present invention. Accordingly, the present invention should not be interpreted as being limited to the embodiments shown and discussed, but should be construed as further encompassing modifications thereof based on the principles set forth in this disclosure.

Panel Combinations and Surface Treatments

The previous discussion illustrates that the structural honeycomb core building panels 102 may be used to form walls, floors, roofs, and other features of a building. Aspects of the present invention relating more particularly to special structural panel combinations and treatments will now be set forth. Attention is again drawn to an aspect of the present invention which provides a continuous adhesive coating or treatment, creating a substantially water-proof and weather-proof wall or similar surface. Other aspects of the present invention which are discussed below include: a structural staggered panel combination providing increased strength for floors, roofs or other load bearing surfaces; a box beam panel combination; and a compound beam panel combination.

In the present structural panel system, the exterior walls 108 are provided with a water-proofing treatment prior to the installation of conventional finishes. This aspect of the present invention conserves materials and reduces material and labor costs by eliminating the need for installing conventional water-proof paper and related materials on the walls. Additionally, the water-proof treatment, when applied to a wall of structural panels 102 incorporating the previously described water-resistant components, provides resistance to water and moisture which exceeds that of many conventional types of construction. Such a water-proofing treatment may be applied to other surfaces which are exposed to water, adverse environmental conditions, etc.

As shown in FIG. 1, the exterior wall 108 includes seams at all panel connection points, such as at the tongue and groove joints 198. Such seams are also found at upper and lower plate connections and at wall edge or corner connections. The seams are covered using conventional exterior joint tape, or mesh. A continuous layer of adhesive is then applied to the entire exterior wall surface, preferably with a roll coater applicator. The thickness of the coating is preferably 4–6 mils depending upon temperature, as the coating runs more readily at higher temperatures. The thickness of the coating applied should be appropriately decreased if more catalysts are added to decrease the set-up time as this causes a greater expansion in the thickness of the coating. Other forms of application may be used to provide a water-proof adhesive coating for the wall. Conventional finishes, such as stucco or wooden siding, may then be applied directly over the water-proof treatment.

FIG. 3 illustrates a staggered combination 420 of structural honeycomb core building panels 102 to form a strengthened structural surface for use in a building such as shown in FIG. 1. In particular, the staggered combination 420 of panels 102 provides added structural strength for use in surfaces such as floors 104 and roofs 106, as shown for the typical house 100.

Preferably, the overall thickness of the panels 102 used in the staggered combination 420 is 6⅛ inches. Upper face sheets 422 preferably comprise exterior grade ⅝-inch plywood which provides strength and allows finishes to be nailed to the surface of the staggered combination 420, if desired. Lower face sheets 424 preferably comprise water resistant gypsum wall board. Alternatively, the staggered panel combination 420 may comprise panels made of different components and thicknesses than those stated as preferable.

The staggered combination 420 of panels 102 shown in FIG. 3 may be fabricated to span relatively large surface areas having virtually any shape of perimeter. However, worst case load conditions will govern the maximum distances which may be spanned using an unsupported staggered combination 420 of panels 102. The staggered combination 420 of panels 102 is provided as follows.

The staggered combination 420 is a series of panel assemblies connected to each other along their lengths, with the width connections of each assembly offset from the width connections of the adjacent assemblies. FIG. 3 shows a first panel assembly 426-1 which comprises a panel 102-1 connected via splice joints 428 to one or two of adjacent panels 102-2, 102-3 along the short edges, or widths, of the respective panels. Similarly, a second panel assembly 426-2 comprises a panel 102-4 connected via splice joints to one or two of adjacent panels 102-5, 102-6 along the short edges, or widths, of the respective panels. The panel assemblies 426-1, 426-2 connect to each other at a mutual side edge via the tongue and groove joint 198 such that the width connections or spline joints of the two assemblies are spaced apart by an offset distance 430.

A third panel assembly 426-3 may be added in a similar fashion, and further panel assemblies may also be added to complete the surface to be spanned by the staggered combination 420. It should be understood that panel dimensions such as the offset distance 430 may be changed as desired. Similarly, the perimeter and shape of the staggered combination 420 is not limited to any particular size or shape. In most cases at least some of the panels used in staggered combination 420 will have dimensions which are less than that of an otherwise full panel.

The splice joints 428 in each panel assembly 426 include the spline 190 as shown in FIGS. 3 and 10 and add strength to the staggered combination 420. However, the staggered combination 420 could also be implemented using the tongue and groove joints 198 as discussed supra in the width connections of the respective panel assemblies 426.

As shown in FIG. 30, another aspect of the present invention provides a box beam 224 which comprises four box beam panel members 434 bonded together to form a box-shaped, rectangular or square cross-section. The box beam 432 may be used as a beam or column for supporting loads in a structure. The box shape provides relatively high strength while keeping the costs and weight of the beam relatively low.

The box beam panel members 434 preferably have a 4-inch overall thickness, although other thicknesses may be utilized. The box beam panel members 434 are provided as sections or portions of a structural honeycomb core building panel 102 and may be fabricated or cut to size from larger sections or panels. Preferably, the face sheets of each box beam panel member 434 comprise water resistant gypsum wallboard. However, plywood or similar materials may also be used.

Each box beam panel member 434 is connected to two other box beam panel members 434 at opposing ends. This forms a box shape having four panel section corner connections. Any of the four corner connections may be implemented with or without a corner post independently of the particular implementation of the other three corners connections. The corner connection details are substantially similar to those described above with respect to FIGS. 8, 9 and 11.

FIG. 30 shows a corner post 436 and a box beam connection plate 438 bonded in opposing channels of a first box beam panel member 434-1. A box beam corner strip 440 of gypsum is bonded to the exposed edge of the corner post 436. Moving clockwise around the box, a first box beam connection plate 438-1 is bonded adjacent to the edge of the first box beam panel member 434-1, and a second box beam panel member 434-2 is installed by bonding it to the connection plate 438-1. The opposing end of the second box beam panel member 434-2 includes another box beam connection plate 438-2 bonded in its channel, and a box beam corner strip 440-2 of gypsum bonded to its edge. Still moving clockwise around the box, third and fourth box beam panel members 434-3, 434-4 are bonded in place in like manner, completing the box shape. The box beam 432 may be finished by applying joint tape 200, conventional metal corner beads 442, and water-proof treatments or the like, as desired.

FIG. 31 illustrates another aspect the present invention which provides a compound beam 444 which comprises two or more compound beam panel sections 446 bonded together to form a rectangular shaped cross-section. The compound beam 444 may be used as a beam or column for supporting loads in a structure. The rectangular shape provides relatively high strength which can be augmented by increasing the number of panel sections 446 in the beam.

The compound beam panel sections 446 preferably have a 4-inch overall thickness, although other thicknesses may be utilized. The compound beam panel sections 446 are provided as short sections or portions of a structural honeycomb core building panel 102 and may be fabricated or cut to size from larger sections or panels. Preferably, the face sheets of each compound beam panel sections 446 comprise water resistant gypsum wallboard. However, plywood or similar materials may also be used.

FIG. 31 illustrates a compound beam 444 comprising two compound beam panel sections 446. A compound beam filler plate 448 is bonded in the respective channels at the opposing ends of each compound beam panel section 446. The compound beam panel sections 446 are bonded to each other, side by side, at a common face sheet surface. The exposed edges of the compound beam panel sections 446 are covered by bonding gypsum compound beam edge strips 450 in place. The compound beam 444 may be finished by applying joint tape 200, conventional metal corner beads 442, and water-proof treatments or the like, as desired.

It should be understood that the foregoing panel combinations and surface treatments are offered by way of example and not of limitation. The examples are intended to illustrate how the features of a building such as the typical house 100 can be implemented using the principles of the present structural building panel 102 and panel building system. Other connections and uses for the structural honeycomb core building panels 102 are contemplated as being within the scope of the present invention. Accordingly, the present invention should not be interpreted as being limited to the embodiments shown and discussed, but should be construed as further encompassing modifications thereof based on the principles set forth in this disclosure.

Devices and Plant Layout for Structural Panel Fabrication

A broader description of the present invention comprises a complete system for fabricating the structural panels 102 and for assembling them to provide a building or other structure. Accordingly, several aspects of the present invention provide for a plant, or factory, for fabricating the structural panels 102 and for the various equipment, devices and systems included in the plant.

Figure 50:
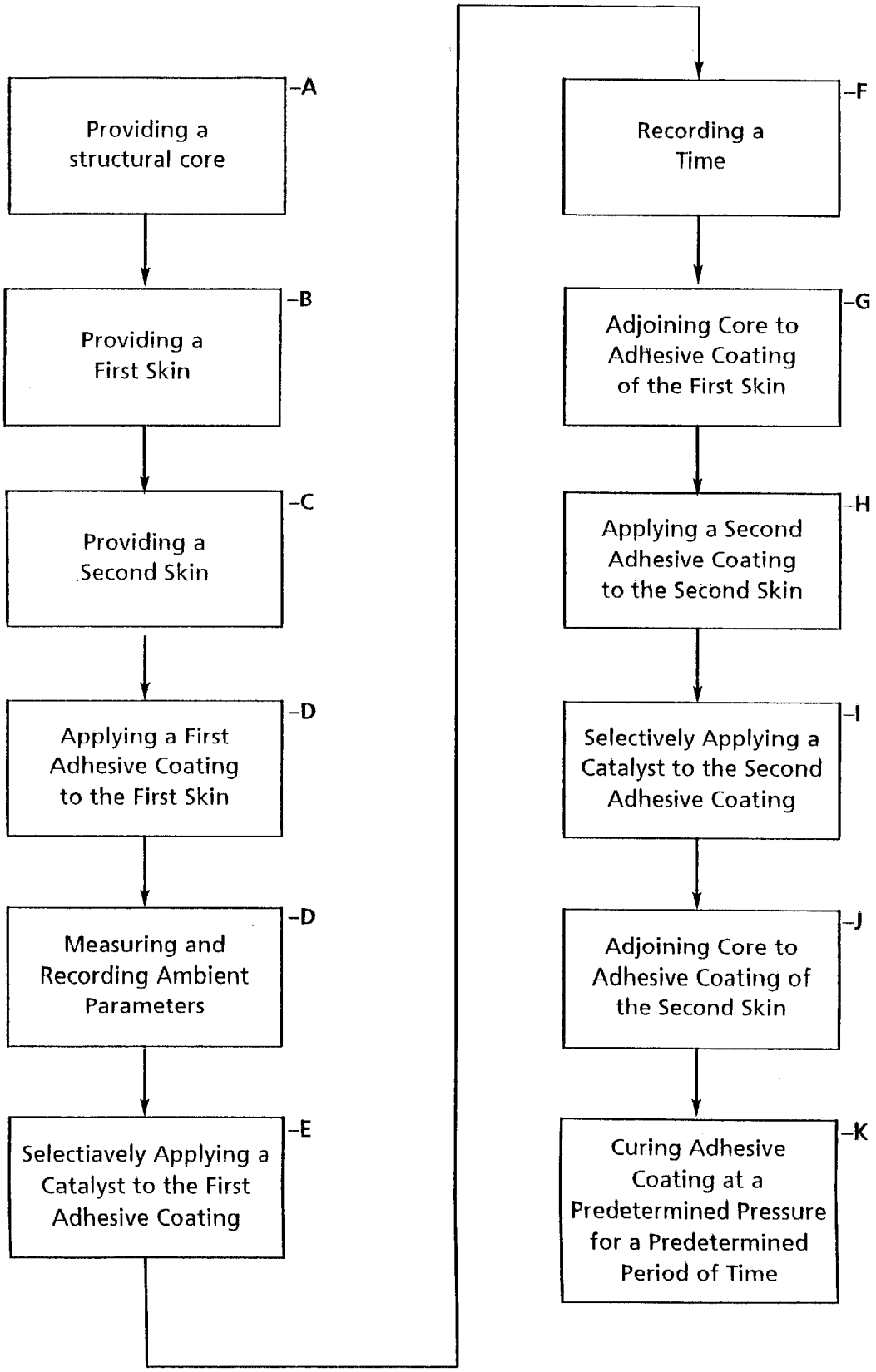
FIG. 50 is a flow diagram illustrating the steps involved in fabricating a batch of structural panels.
Figure 51:
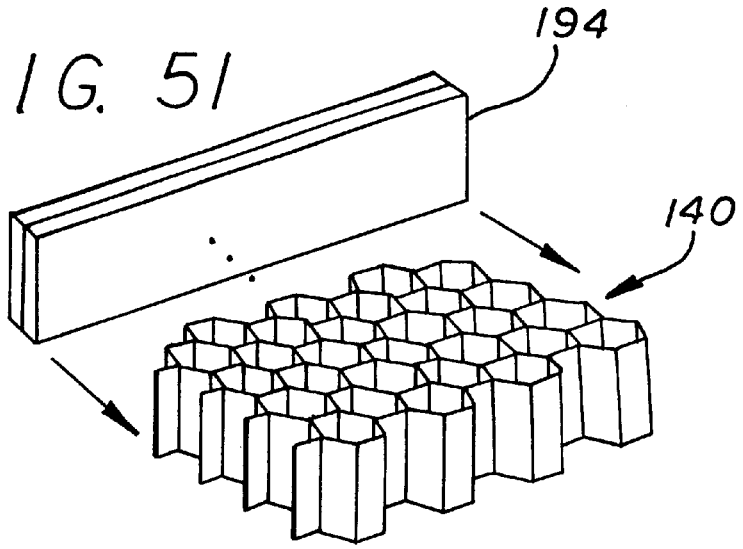
FIG. 51 illustrates how the structural core is expanded into shape.
Figure 52:
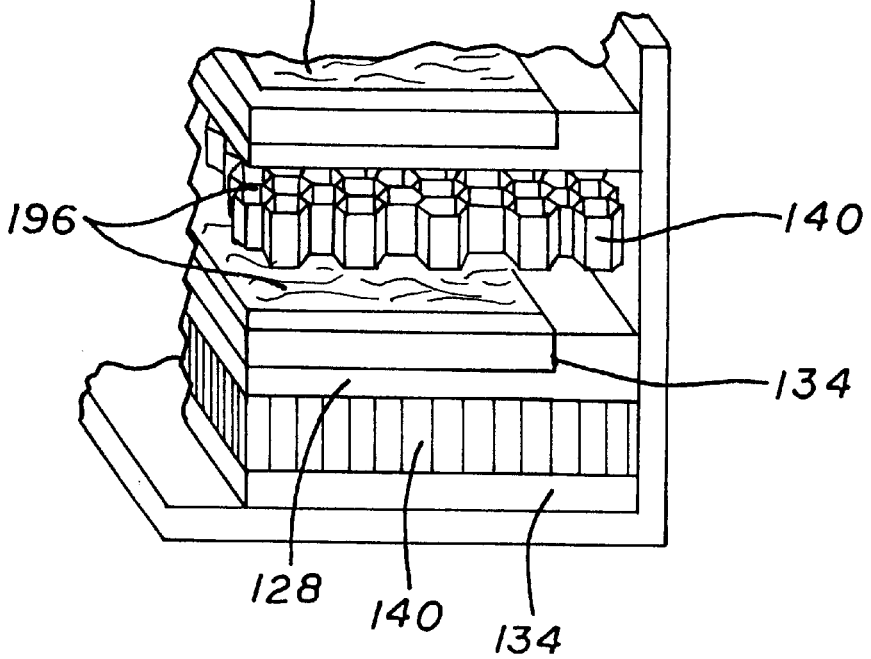
FIG. 52 illustrates details of structural panel fabrication according to the method of the present invention.

Referring to FIG. 50, a flow diagram is shown illustrating both the steps involved in fabricating a batch of structural panels 102 according to the present method, and the preferable equipment, devices, or systems provided for implementing the method. The general steps of the method are enclosed in boxes having solid borders. The particular devices used to implement the respective steps are enclosed in boxes having dashed borders. FIG. 51 illustrates some details of expanding the paper in step A, while FIG. 52 illustrates details included in steps B–L as described below and with reference to FIG. 50.

The present fabrication method should not be construed as being limited by the preferred equipment disclosed for implementing the method. Accordingly, many details of the structural panel fabrication method are discussed in a separate portion of the disclosure below. The following discussion focuses primarily on the details of the preferred equipment, devices, and systems used in the plant.

Expander System

Referring now to FIGS. 40–46, an aspect of the present invention provides an expander system 500 for expanding honeycomb paper provided in unexpanded form. The paper expansion speed and core "setting" heat can be regulated by the expander system 500 to provide for expanded honeycomb paper cores 140 of various thicknesses having the desired resiliency, strength, and cell densities for the particular structural panel 102 sought to be fabricated. Controls are provided in the system 500 to regulate and monitor the expansion process, helping to ensure the quality of the expanded cores. Hence, the expander system 500 is capable of expanding paper to provide appropriate resiliency and strength of the resulting expanded honeycomb paper cores 140.

Figure 40:
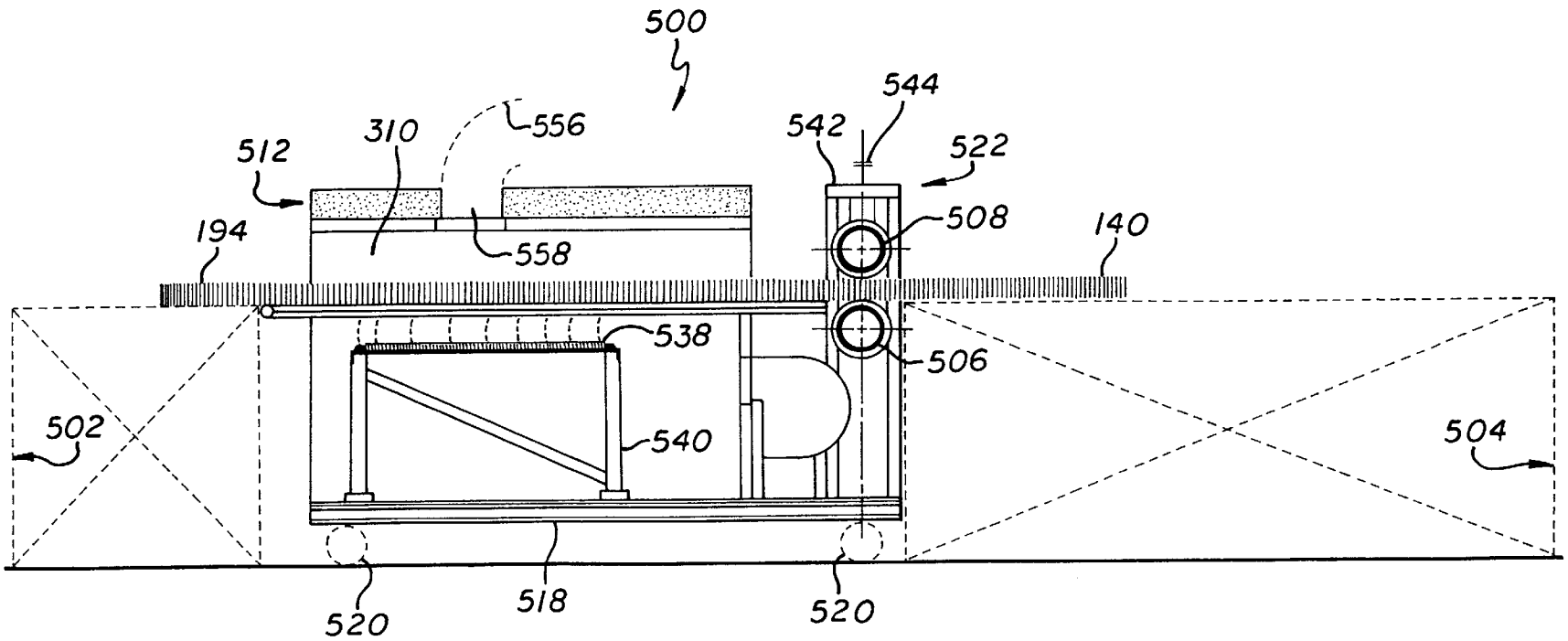
FIG. 40 is a sectional side view of an expander system embodying principles of the present invention.
Figure 41:
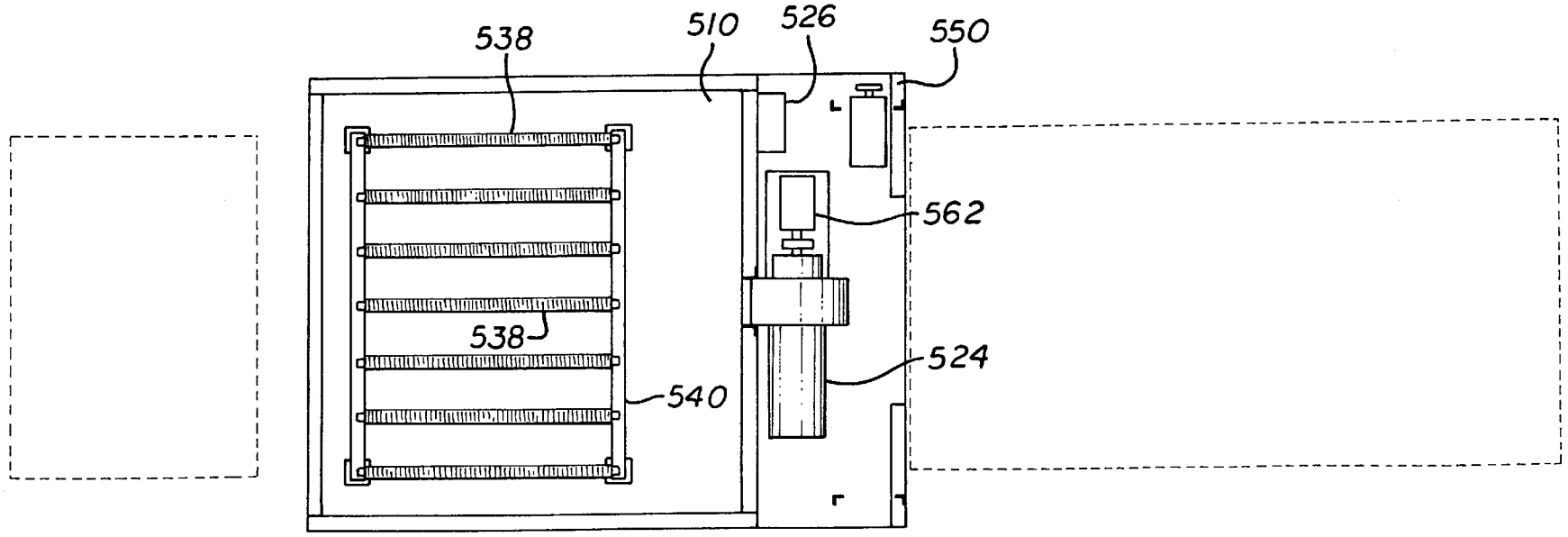
FIG. 41 is a sectional top view of the expander system of FIG. 40.

FIGS. 40 and 41 illustrate the expander system 500 in sectional views. Referring particularly to FIG. 40, unexpanded honeycomb paper 194 is provided in a paper shipping crate 502 at the rear of the expander system 500. The expanded honeycomb paper 140 is shown exiting the front of the expander system 500 onto a cutting table 504. Motor driven rollers, or drums, such as fixed roller 506 and adjustable roller 508, are used to draw or pull the paper through a heated chamber 510 of the expander system 500. As mentioned above, both the heat of the chamber and the rate of paper draw may be regulated.

As is best illustrated in FIGS. 42–43 and 45–46, the chamber 510 is provided by a metal enclosure 512 comprising a top portion 514 and bottom portion 516 which are latched, bolted, hinged, or otherwise secured together. The enclosure 512 is mounted on a platform or frame 518, which may be provided with wheels or castors 520 for mobility. An expansion assembly 522 is also mounted on the platform 518, at the front of the expander system 500. The rate of draw, or expansion rate of the paper is regulated by the expansion assembly 522. The platform 518 also carries a blower assembly 524 (FIG. 41), provided for the purpose of maintaining a relatively even temperature distribution in the chamber 510, especially near the top of the expanding paper. Finally, a control panel 526 (FIG. 41) is provided near the front of the system 500 for controlling the expansion rate and chamber temperature.

As shown in FIG. 40, the paper enters the chamber 510 through a feed opening 528 and exits the chamber 510 through an exit opening 530 while being supported by a paper feed support rack 532 which runs through both the feed opening 528 and the exit opening 530.

As shown in FIG. 42, the rack 532 preferably comprises a plurality of spaced rigid members 534 running in the same direction as the paper is drawn. Each rigid member 534 is welded or otherwise secured to an edge bar 536 which is preferably rounded to allow the paper to flow over it. The components of the rack 532 are preferably made of steel or some other material capable of withstanding high temperatures, such as ceramic.

As shown in FIGS. 40 and 41, a plurality of heating elements 538 are disposed in the chamber 510 below the support rack 532. The heating elements 538 are mounted on a support frame 540, comprised of steel or other high temperature material. Preferably, the heating elements 538 are evenly spaced throughout the width of the chamber 510.

The heating elements 538 preferably comprise a thermoelectric core material encircled by a plurality of fins made of tin, copper, or similar heat conducting material. The temperature in the chamber 510 may be regulated by controlling the flow of electrical current through the heating elements 538. A heating element regulator, or thermostat, is provided to control and regulate the operating temperature of the heating elements. A suitable thermostat is model DI-7071-KEP sold by Therm-Coil Mfg. Co., West Newton, Pa.

The heating elements 538 provide heat so the expanding paper can be thermo-set, or heat-set to the desired expanded dimensions. Too much heat causes brittleness of the expanded paper, while too little heat causes the expanded paper to be "spongy", that is, lack the required stiffness, and to lose its desired cell shape over time. Whether too much or too little heat is applied during expansion, both cases will result in a core 140 that does not have the required structural strength for building a structural panel 102.

As shown in FIGS. 40, 42 and 43, the expansion assembly 522 includes roller mounting frames 542 upon which adjustable roller 508 and the fixed roller 506 are mounted, as well as the other components discussed below. The rollers are preferably mounted in bearings in a conventional manner, and preferably have rubber surfaces for engaging the paper. Adjustment knobs 544 are provided at the top of each mounting frame 542 for adjusting the distance between the rollers 506, 508 to accommodate various paper thickness. Rotation of the adjustment knob 544 rotates a respective lead screw 546, which effectuates an up or down motion of a slide mounting bracket 548 upon which the adjustable roller 508 is mounted.

As shown in FIG. 44, the fixed roller 506 is fitted with an idler pulley 550 and is driven by the drive pulley of an expansion drive motor 552 via a drive belt 554. The motor 552 may be provided as Model 2M169 ¾ horsepower electric motor manufactured by Dayton Electric Mfg. Co., Chicago, Ill. A silicon controlled rectifier (SCR) speed control, also manufactured by Dayton, is preferably provided to regulate the motor speed, and hence the paper draw rate, through the control panel 526.

The blower assembly 524 is provided for maintaining an even temperature distribution in the chamber 510 by circulating air through the chamber 510. Air is drawn from the bottom of the chamber by the blower 524. As shown in FIGS. 42, 43, 45 and 46, air is then distributed to the top of the chamber through an air guide or duct 556 which attaches to air flow port 558 (FIG. 42) at the top of the enclosure 512.

As illustrated in FIG. 44, a conventional blower or fan (not shown) is provided, encased within a blower housing 560. A blower drive motor 562 and a coupling 564 are provided for turning or driving the blower 524 in a conventional fashion, such as via drive belts, clutches, or gearing. The blower drive motor 562 may comprise a Century AC motor, CAT:C669, ¾ HP, available from MAGNETEK, St. Louis, Mo., or similar component.

The cutting table 504 is a conventional table which may have marks or lines to aid in measuring and cutting the expanded paper to desired core lengths. For example, the cutting table 504 is preferably sized in excess of 10 feet long, and is pre-marked to measure cores for 8, 9 or 10 foot panels.

Stacking Platen

Figure 37:
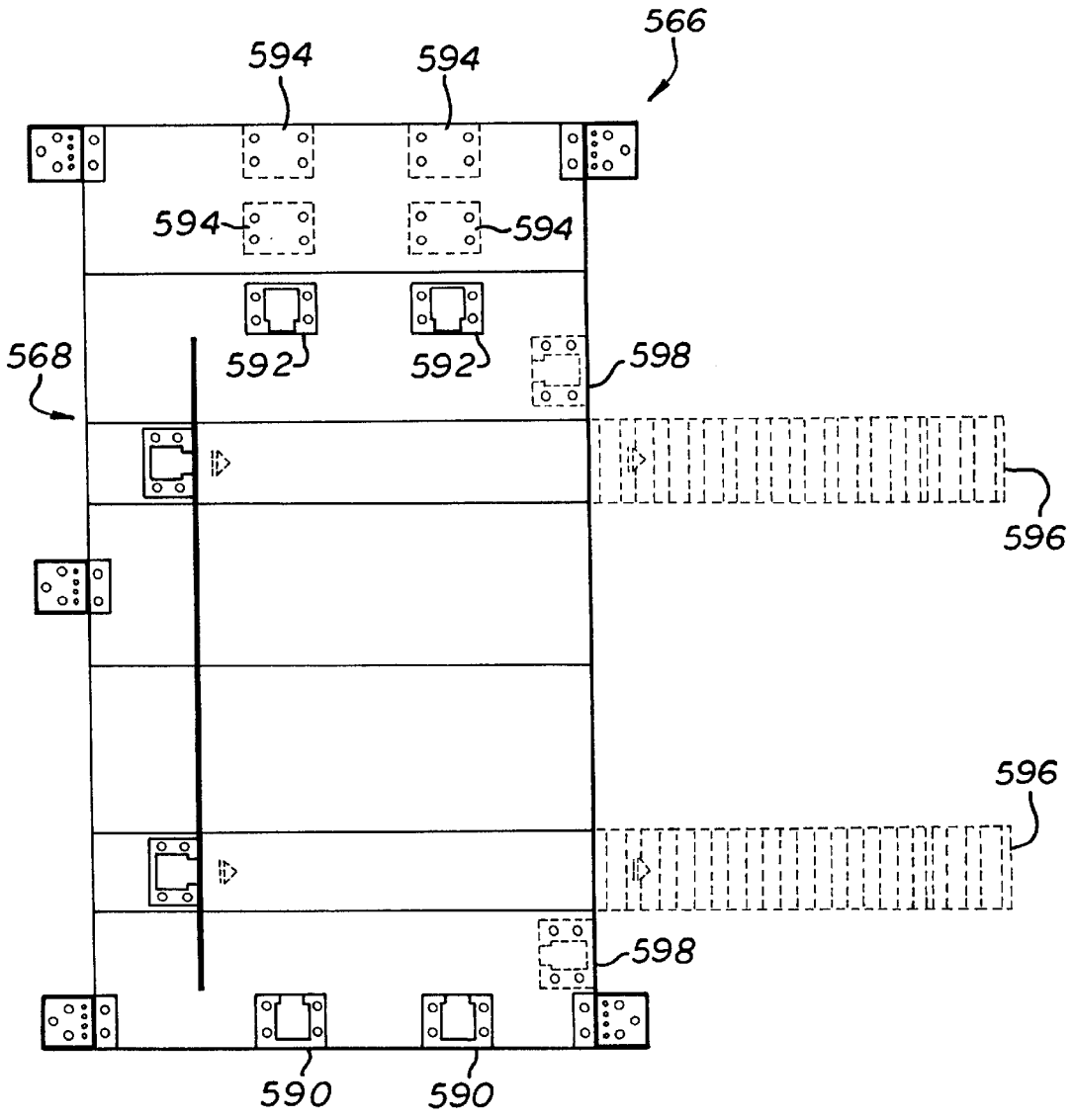
FIG. 37 is a top view of a mobile assembly platen embodying principles of the present invention.
Figure 38:
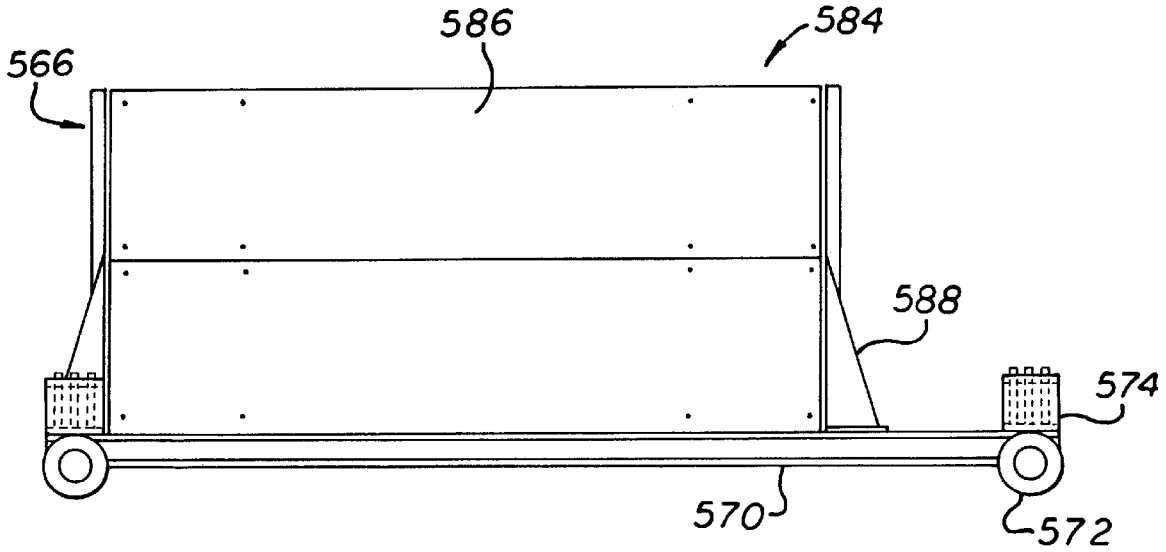
FIG. 38 is a front view of the mobile assembly platen of FIG. 37.
Figure 39:
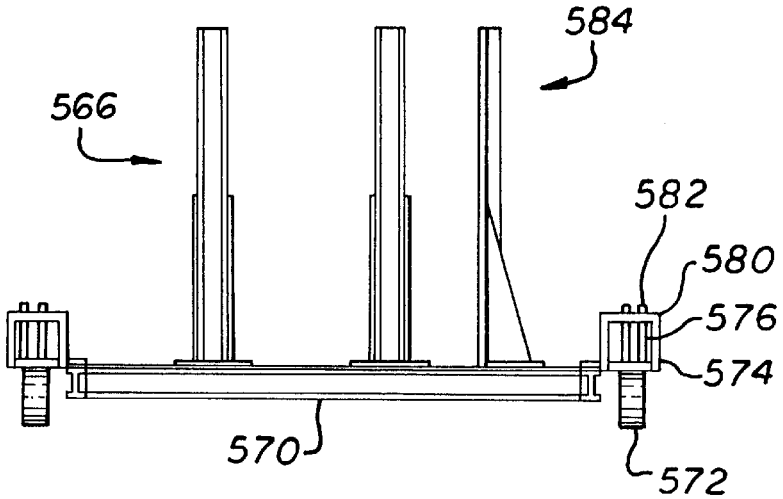
FIG. 39 is a right side view of the mobile assembly platen of FIG. 37.

Referring now to FIGS. 37–39, an aspect of the present invention provides stacking platen, or table 566 for stacking or assembling panel components during the gluing procedure. Before curing, the panels 102 may be considered "wet" since the adhesive has not yet cured. Glue, or adhesive, is applied to the face sheets 128,134. Guides on the stacking platen 566 are used to properly align the face sheets 128, 134 on either side of the honeycomb core 140. The foregoing arrangement forms the wet panel. The wet panels are stacked in batches on the stacking platen 566 for subsequent curing in a vacuum bag. The platen 566 is positioned in a vacuum bag during curing and provides a uniform flat surface for distributing the force applied to the stack (batch) of panels. More than one platen 566 may be used to speed production.

A substantially flat platform 568 is secured to a support frame 570. Wheels or castors 572 are preferably attached to the support frame 570 so that the platen 566 may be maneuvered into a vacuum bag (discussed infra), or otherwise moved around the plant. To aid in distributing forces over the platform surface during vacuum curing, the castors 572 are preferably spring mounted.

One way to accomplish this is to secure each castor 572 to three mounting shafts 574, each surrounded by a spring 576 engaging the top of a pressure plate 578 at its bottom end and the bottom of a mounting bracket 580 at its top end, as shown in FIGS. 38 and 39. The mounting shafts 574 penetrate respective holes in the mounting bracket 580 and have a thrust-stop, or head 582 which contacts the top of the mounting bracket 580. Such an arrangement allows for the springs 576 to compress as weight or pressure is applied to the stacking platen 566, eventually allowing the platen 566 to sit firmly on the ground. Preferably the vacuum bag has a hard flat surface onto which the platen 566 will compress during curing, allowing forces to be evenly distributed over the surfaces of the stacked panels 102.

A stacking guide plate 584 is provided near the rear of the stacking platen 566 as a substantially flat vertical surface. The stacking guide plate 584 comprises a guide plate 586 bolted or otherwise secured to guide mounting brackets 588. The guide plate 586 and the mounting brackets 588 are preferably made from steel or aluminum, but may comprise other materials.

As shown in FIG. 37, fixed stacking guides 590 are provided at one side of the stacking platen 566. Adjustable stacking guides 592 are provided for accommodating panels 102 of various dimensions. Alternate mounting positions 594 are provided for the adjustable stacking guides 592. The three positions shown for mounting the adjustable stacking guides 592 correspond to panel lengths of 8, 9 and 10 feet, respectively. Alternatively, a continuous range of mounting positions could be provided for the adjustable stacking guides 592 using conventional mounting equipment.

Sheet loading rollers, or pins 596 are optionally set up in front of the stacking platen 566 to more easily stack panel components. Edge holders, or stacking guides 598 may be bolted or otherwise secured near the front of the platen 566 after the panels 102 are stacked to help secure the stack of panels 102 during curing.

Glue Gun and Table

A glue gun and gluing table are conventional items already in use with the Mor-Ad 612 adhesive. The adhesive comes in 55 gallon drums having two bung holes on the top. An airless pump is used to transfer the adhesive from the drum to a roll coater, bead applicator, or spray wand. Grover Mfg. Co., of Montebello, Calif. supplies model R40-B23 pump which attaches directly to a bung hole on top of the drum.

Since moisture is the curing agent for the adhesive, the manufacturer recommends special handling procedures to keep from fowling the pump, pipes, hoses or fittings with cured adhesive. A preferable method is to provide an air compressor attached to the second bung hole or at a suitable fitting. The system is then purged, plugged and charged with compressed air when not in use to prevent unwanted curing of the adhesive due to ambient moisture.

Vacuum Bag Curing System

Figure 47:
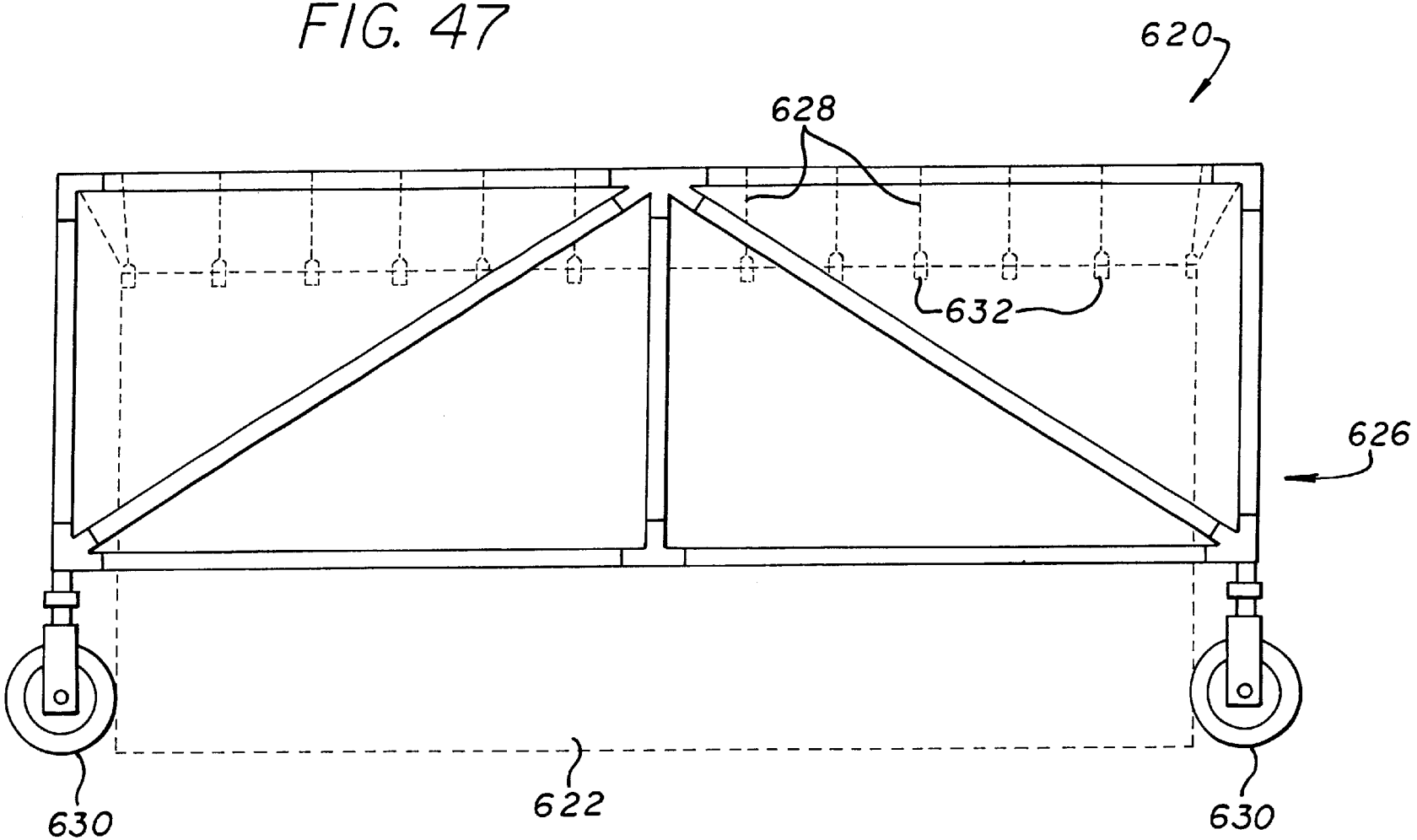
FIG. 47 is a front view of an evacuation system embodying principles of the present invention.
Figure 48:
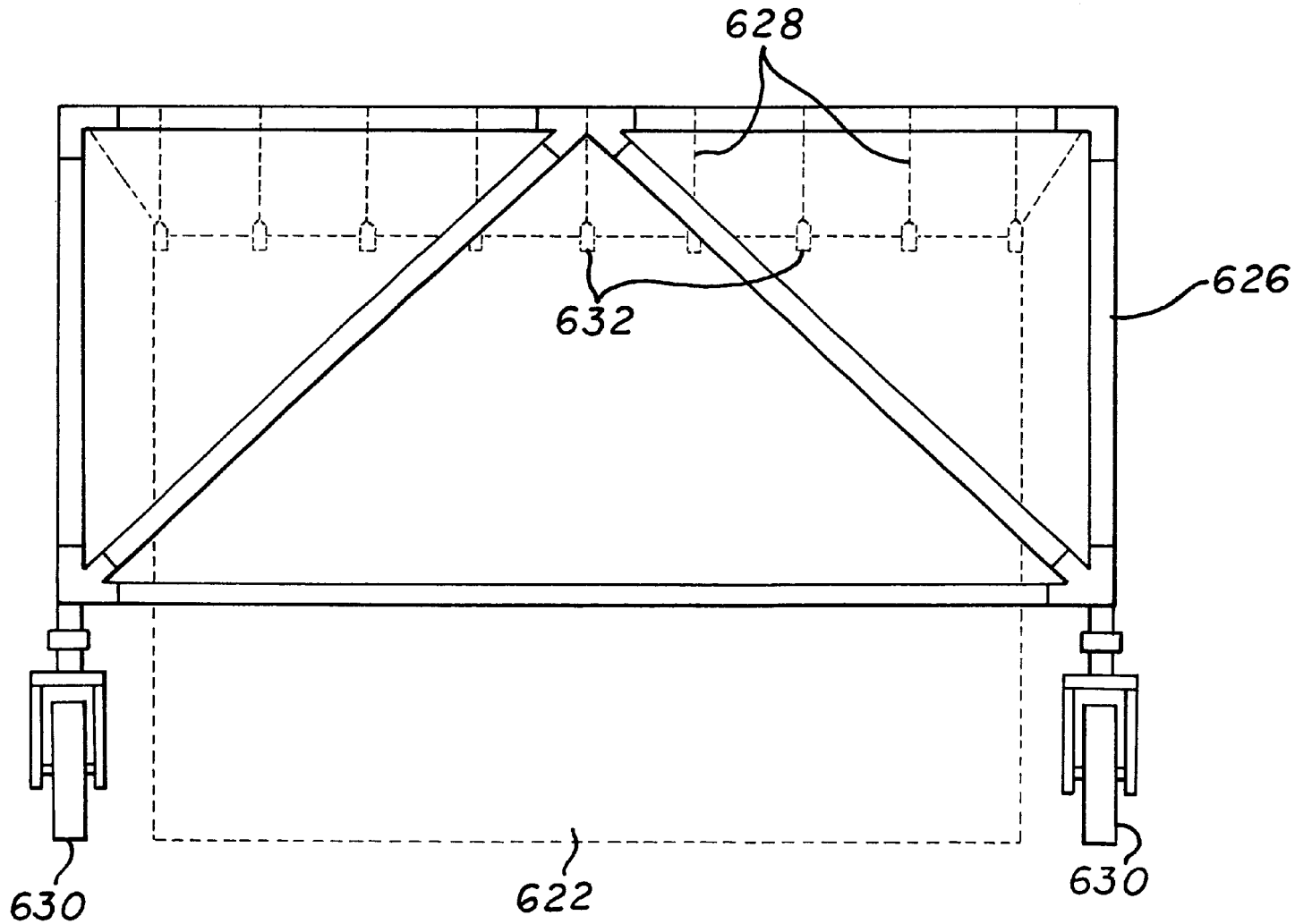
FIG. 48 is a right side view of the evacuation system of FIG. 47.
Figure 49:
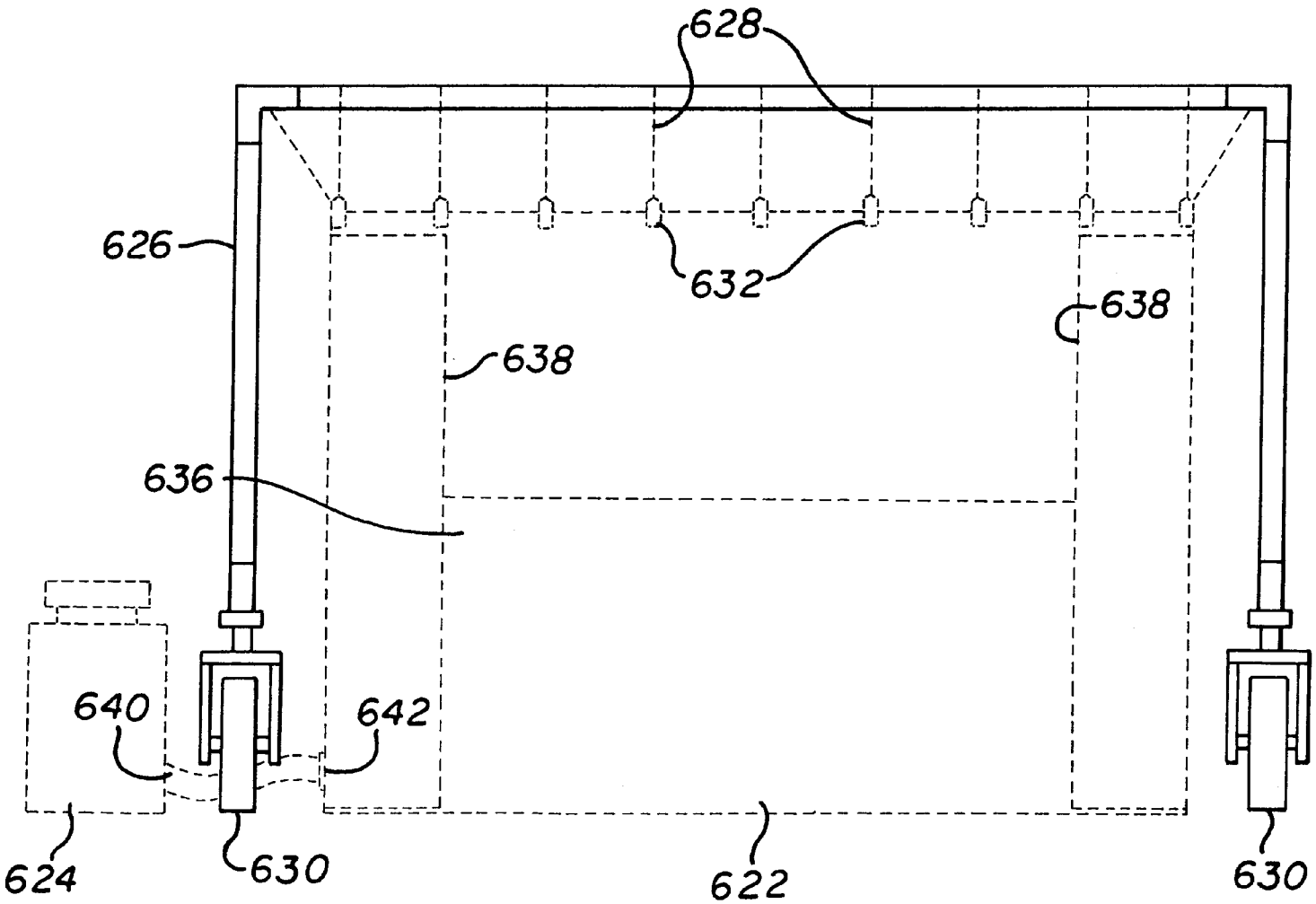
FIG. 49 is a left side view of the evacuation system of FIG. 47.

FIGS. 47–49 show a vacuum bag curing system 620 for applying pressure to a stack of wet panels 102 during curing. During curing, a vacuum bag, or tent 622 accepts and surrounds the mobile stacking platen 566 containing a batch of wet panels 102. The bag 622 is detached from its support frame and air is evacuated from the bag using an air pump, or vacuum pump 624 (FIGS. 48 and 49). Pressure in the bag 622 is reduced to between 5 and 10 pounds per square inch (psi). Since atmospheric pressure is approximately 15 psi under most conditions, each panel 102 in the stack experiences a net pressure of between 5 and 10 psi distributed evenly over its surface. Such pressure, applied for an appropriate amount of time, cures the adhesive bond between the face sheets 128, 134 and the core 140 in a manner which provides for the structural integrity of the finished panel 102.

The vacuum bag 622 is suspended from an overhead support frame 626 by cords, ropes or bungees 628. The frame 626 may be constructed from pipes and fittings, as shown, or other rigid framing materials such as angle iron. The frame 626 is preferably mounted on wheels or castors 630. The cords 628 are hooked to or otherwise attached to the frame 626 in a conventional fashion. The cords 628 connect the frame 626 to the bag 622 using fasteners 632 which comprise reinforced vinyl strips, or similar material. The fasteners 632 are preferably bonded to the bag 622 using a suitable adhesive, rather than being sewn, to maintain air tightness.

The vacuum bag 622 comprises a reinforced vinyl diaphragm, although a rubber diaphragm may be used. Preferably, 15 to 20 gauge reinforced vinyl is used, with any seams in the bag being treated with adhesive or other compound to be air tight. The bag 622 shown in the figures includes an opening at one end accessible via a top flap 634 and a bottom flap 636 situated between side gussets 638, as shown in FIG. 49. The flaps are preferably sealed with several inches of adhesive material such as that known by the tradename "VELCRO" during curing. The opening allows the platen 566 to be put inside the bag 622. The bag 622 includes a continuous vinyl bottom surface over which the platen is placed.

The vacuum pump 624 (producing 2–5 inches of mercury) connects to the bag 622 through a hose 640 and a vacuum takeoff 642, preferably having a 4-inch reinforcing flange inside the bag.

Alternatively, the vacuum bag 622 may include neoprene gaskets on its skirt, connected to steel or angle iron, rather than having a vinyl floor or bottom. The gaskets are provided of a size and shape suited to seal under the bottom of the assembly platen when it is placed over them. In this aspect, the platen may be fitted with removable wheels or wheels which allow the table to be lowered to the ground once positioned over the gasket.

Method of Fabricating Structural Panels

The structural honeycomb core building panels 102 are preferably fabricated in batches of between 8 and 10 panels using the fabrication method illustrated in block diagram form in FIG. 50. However, the present method can be adapted to fabricate a number of panels outside the foregoing range. The fabrication method is described below.

Step A: expanding an impregnated, unexpanded honeycomb paper core 194 which is provided in continuous or ribbon form. During expansion, both the temperature and expansion rate are regulated to ensure the strength and resiliency of the expanded honeycomb paper core 140.

Still referring to FIG. 50, the unexpanded honeycomb paper 194 of FIG. 50 may be obtained from vendors, including the HEXACOMB HONEYCOMB CORPORATION, located in Saint Louis, Mo., or HEXCEL, located in Dublin, Calif. These vendors provide the unexpanded honeycomb paper 194 in continuous or ribbon form having a range of specifications which may be designated by the purchaser. The present method may be adapted for use with virtually any combination of available specifications for the unexpanded honeycomb paper 194.

Preferably, for fabricating the structural honeycomb core building panels 102 for use in floors 104 and roofs 106, the unexpanded honeycomb paper core 194 is provided in continuous or ribbon form with the following specifications: thickness of 5½ inches; expanded width of 4 feet within conventional tolerances; 99 pounds per ream standard paper weight (one ream equals 3000 square feet); cell size of 1½ inches measured across the flats of the cell; and an 18% resin impregnation content as a percentage of the finished paper weight. For fabricating the structural honeycomb core building panels 102 for use in walls 108 and other building details, the preferred unexpanded paper core 194 specifications are identical except that the thickness is changed to 3½ inches. In both cases it is also preferable to specify that the vendor provide further impregnation of the unexpanded honeycomb paper core 194 with fire-retardant additives.

The 18% phenolic resin impregnation provides the paper core 140 with substantial waterproofing and moisture resistance. The resin impregnation also provides resistance to insects, termites and vermin as well as preventing the growth of fungus and other molds. The fire-retardant impregnation provides excellent resistance to combustion. These properties of the paper core 140 are complimented by the present method and choice of materials to provide a structural honeycomb core building panel 102 with excellent resistance to water, moisture, pests and fire.

Preferably, the core is obtained in its unexpanded form 194 so that it may be economically shipped to the building site, or to a nearby location, for expansion. Alternatively, the core 140 may be obtained from vendors in its expanded form, thereby eliminating step A. However, this alternative is cost prohibitive in most cases due to high shipping costs and losses due to core breakage during shipping. Accordingly, the present invention provides a novel expansion method in step A and an expander system 500 for expanding the unexpanded honeycomb paper core 194 at the building site or at a convenient location near the building site.

Step A provides for expanding the unexpanded honeycomb paper 194 in the chamber 510 heated to a uniform temperature of approximately 380–450° F. with the air being circulated near the paper 194. This is accomplished by pulling or drawing the honeycomb paper 194 through the heated chamber 510 at a substantially uniform expansion rate. For example, a classic panel of 3½ inch thickness and 8 feet length takes approximately 6 minutes to be drawn through the heated chamber 510 (i.e., 16 inches/minute). The expansion rate should be appropriately decreased if a fire retardant material has already been applied to the paper 194. The substantially uniform temperature and expansion rate provide an expanded honeycomb paper core 140 which has the appropriate strength and resiliency for use in structural panels. More particularly, brittleness of the expanded honeycomb paper core 140 is avoided by the present expansion method.

The method of the present invention additionally includes steps B-L and substeps of these steps. Generally, the method of making at least one composite structural member comprises the steps of:

(A) providing a structural core comprising at least one core portion, said core portion further comprising a plurality of honeycomb cells, each of said plurality of cells further comprising a plurality of paper web members, said honeycomb core having a predetermined shape, predetermined thickness, and predetermined structural properties, and also having a first side and second side thereof corresponding to opposing ends of said web members;

(B) providing a first skin having a predetermined shape, predetermined thickness, and predetermined structural properties, said skin including a first and second surface;

(C) providing a second skin having a predetermined shape, predetermined thickness, and predetermined structural properties, said skin including a first and second surface;

(D) applying a first adhesive coating to a portion of said first surface of said first skin;

(F) selectively applying a catalyst to said first adhesive coating to substantially control the curing time thereof;

(H) adjoining a portion of said first side of said honeycomb core with a portion of the adhesive coated first surface of said first skin;

(I) applying a second adhesive coating to a portion of said first surface of said second skin;

(J) selectively applying said catalyst to said second adhesive coating to substantially control the curing time thereof;

(K) adjoining a portion of said second side of said honeycomb core with a portion of the adhesive coated first surface of said second skin; and (L) curing said adhesive coating at a predetermined pressure for a predetermined period of time;

wherein a composite structural member is produced which significantly resists creep and delamination between said first and second skin and said honeycomb core, thereby providing substantially desirable structural properties.

After the expanded honeycomb core 140 is cut to a desired length, the panels are assembled with the adhesive coating being applied as described above. The application of an appropriate (time, temperature, pressure sensitive variation) coating of curing agent to the adhesive coating is an important aspect of the present invention. For example, the following table shows Mor-Ad M-600 Series Cure Schedules with a 4–5 mil bond line at various temperatures.

TABLE 1

Mor-Ad M-600 Series Cure Schedules
4–5 Mil Bondline

| Temperature | MA M-610 | MA M-612 | MA M-613 |
|---|---|---|---|
| 60 °F. | 79 (160) | 48 (98) | 29 (81) |
| 65 °F. | 71 (149) | 40 (88) | 26 (70) |
| 70 °F. | 65 (149) | 33 (79) | 22 (61) |
| 75 °F. | 58 (121) | 28 (71) | 20 (53) |
| 80 °F. | 52 (121) | 23 (64) | 17 (47) |
| 85 °F. | 47 (112) | 19 (57) | 15 (41) |
| 90 °F. | 42 (105) | 16 (52) | 13 (36) |
| 95 °F. | 38 (97) | 13 (46) | 11 (32) |
| 100 °F. | 34 (91) | 11 (42) | 10 (31) |

Table 1 provides maximum times (in minutes) to position the panels into the press before the press is turned on. The press time (in minutes) is given in parentheses. The above information is based on a continuous thin film and water fogged (½ grams per square foot) as catalyst to activate the adhesive. As may be readily appreciated, the speed of panel production is governed by a variety of factors including temperature, humidity, the type of adhesive used, and the number of panels per stack under pressure. It has been observed that a preferred range of temperatures within the chamber is between 70° F. and 75° F. as the adhesive may set up too quickly at higher temperatures.

Step A may further include the substeps of:

(A)(1) providing an expandable honeycomb paper web of a predetermined paperweight, predetermined thickness, predetermined width and predetermined nominal honeycomb cell size;

(A)(2) expanding the paper web at a predetermined temperature and at a predetermined expansion speed, thereby providing continuous honeycomb core sheet stock having said predetermined thickness corresponding to said predetermined thickness of said expandable honeycomb paper web, a predetermined width substantially determined by selecting a particular width value for the predetermined honeycomb web width and a predetermined value for said predetermined expansion speed, and a predetermined resiliency range for ensuring said predetermined structural properties of said honeycomb core;

(A)(3) cutting the honeycomb core sheet stock to comprise an arbitrary geometric shape corresponding to said predetermined shape of said honeycomb core, and in some circumstances substep (A)(3) further comprising cutting said honeycomb core sheet stock in a direction orthoganal to the width thereof to provide said honeycomb core portion with a substantially rectangular shape corresponding to said predetermined shape; and (A)(4) removing fractional portions of said honeycomb core to provide receptacle openings of arbitrary geometric shape disposed within said predetermined geometric shape of said core, said receptacle openings being adapted to receive fixtures, members, and the like disposed at least partially within such structural core. The structural member core of Step A may further comprise a plurality of core portions, each of said core portions further comprising a plurality of honeycomb cells, each of such plurality of cells further comprising a plurality of paper web members, each of said core portions having a predetermined shape, predetermined thickness, and predetermined structural properties, and also having a first side and a second side thereof corresponding to opposing ends of said web members.

Step B may further include the substeps of:

(B)(1) cutting the honeycomb first skin to comprise an arbitrary geometric shape corresponding to said predetermined shape thereof; and (B)(2) removing fractional portions of said first skin to provide receptacle openings of arbitrary geometric shape disposed within said predetermined geometric shape thereof, said receptacle openings being adapted to receive fixtures, members and the like disposed at least partially within said first skin.

Step C may further include the substeps of:

(C)(1) cutting said honeycomb first skin to comprise an arbitrary geometric shape corresponding to said predetermined shape thereof; and (C)(2) removing fractional portions of said first skin to provide receptacle openings of arbitrary geometric shape disposed within said predetermined geometric shape thereof, said receptacle openings being adapted to receive fixtures, members and the like disposed at least partially within said first skin.

The method of making at least one composite constructural member may additionally include Step E and Step G. Step E comprises measuring and recording ambient parameters prior to selectively applying the catalyst in Step F. Step G comprises recording a time substantially contemporaneously with the occurrence of selectively applying the catalyst during Step F. Step E may further comprise the substeps of: (E)(1) measuring an ambient temperature value; and (E)(2) measuring an ambient humidity value.

Each of the first and second adhesive coating of Steps D and I may comprise the application of a one-component moisture cured adhesive in which the catalyst further comprises water in the form of moisture. Additionally, Steps F and J may further comprise uniformly applying said moisture as the catalyst to one of the first and second adhesive coatings, respectively, based on said measured ambient humidity value. The moisture may be applied as fogged water spray in the range between 1–2 grams per square foot if the ambient humidity value is below a predetermined ambient humidity threshold, with said moisture not being applied if said ambient humidity value is above a predetermined sufficient ambient humidity threshold. Such moisture may be applied as a water fogged spray in a variety of ways such as using a manually operated spray device, spray bar, etc.

Step D may further comprise the substeps of:

(D)(1) marking at least one portion of said first surface of said first skin comprising an area wherein adhesive is not to be applied; and (D)(2) applying said first adhesive coating to portions of said first surface other than said marked portion in Step (D)(1). The first adhesive coating may be applied in a substantially uniform manner with a continuous thickness of, for example, approximately 5 mils. Similarly, Step I may further comprise the substeps of: (I)(1) marking at least one portion of said first surface of said second skin comprising an area wherein adhesive is not to be applied; and (I)(2) applying said second adhesive coating to portions of said first surface other than said marked portion in Step (I)(1). The second adhesive coating may be applied in a substantially uniform manner with a continuous thickness of, for example, approximately 5 mils.

Step L may further comprise curing said first and second adhesive coating within a predetermined pressure range for a predetermined period of time, depending upon said measured ambient temperature. Alternatively, Step L may further comprise curing said first and second adhesive at said predetermined pressure prior to the expiration of a working time for said catalyst activated adhesive.

Another aspect of the present expansion method is that the cell density and cell dimensions of the expanded honeycomb paper core 140 can be controlled. Cell strength is increased by decreasing the cell size (i.e., the distance between opposing walls of a cell). A typical range of cell sizes for nominally expanded cells is between ½ inch and 1⅜ inch. Asymmetrical honeycomb cells may be provided by the present expansion method providing for the fabrication of a structural honeycomb core building panel 102 having greater strength along a particular cell axis, for example, along the length of the panel. Greater strength along the panel length provides the advantage of greater load bearing ability in the direction of the longer span of the panel 102. Accordingly, an assembly of panels with desired load bearing characteristics may also be fabricated via selective orientation of the panels comprising the assembly.

FIG. 5*b* shows the expanded honeycomb paper core 140 in detail. As shown in FIGS. 5*d* and 5*e*, the plurality of honeycomb cells 142 may be fabricated with the longitudinal cell dimension 154 being shorter than the transverse cell dimension 158, or vice versa. The longitudinal cell dimension 154 is generally along the same direction 156 as the length of the structural honeycomb core building panel 102. The transverse cell dimension 158 is generally along the same direction 160 as the width of the structural honeycomb core building panel 102.

The shorter longitudinal cell dimension 154 results in greater strength along the width of the finished structural honeycomb core building panel 102. Such a panel 102 is fabricated by decreasing the pulling or drawing rate of the unexpanded honeycomb paper 194 through the heated chamber 510.

FIG. 5*f* is a top view of the honeycomb core 140 showing a typical prefabricated cutout opening disposed within the core 140. FIG. 5*g* is a top view of a honeycomb core 140 comprising a plurality of core portions each having particular honeycomb cell dimensions and orientations as discussed above.

With reference to FIGS. 2 and 50, step B calls for cutting the expanded honeycomb paper core 140 to a desired length. The length 184 of the paper core 140 is determined by the size of the structural panel 102 which is to be fabricated. By way of example and not of limitation, the structural panels 102 may be fabricated in lengths of 8, 9, or 10 feet.

In most cases, the structural panel 102 is fabricated having a first channel 178-1 and a second channel 178-2 on its top and bottom edges, respectively. The paper core 140, in such cases, is nonetheless cut to the overall length of the structural panel 102. The cutting may be done with a sharp knife, cut-off saw, band saw, or the like. The paper core 140 is cut to at least the same length as the finished panel 102 so that the excess core material initially fills the channels 178-1, 178-2, 178-3 to prevent damage to the panels 102 during handling prior to installation.

If the length of the paper core 140 is too large, the structural honeycomb core building panel 102 may nonetheless be fabricated. As discussed above, the depth of any of channels 178 may be adjusted in the finished structural panel 102 using an ordinary hammer or similar tool to knock excess core paper out of the channel. The glue lines are provided during gluing to ensure that the excess core material is not bonded in the channel regions.

It should be understood that the foregoing asymmetrically fabricated panels are offered by way of example and not of limitation. The examples are intended to illustrate how the features of a building such as the typical house 100 can be implemented using the principals of the present structural building panel 102 and panel building system. Other connections and uses for the structural honeycomb core building panels 102 are contemplated as being within the scope of the present invention. For example, the structural panels may be fabricated in a curved shape to form columns or the like. After fabrication, the structural panels may be cut into any desired shape, or interior portions may be cut from the panels (e.g., for windows), without compromising the substantially moisture impervious quality of the panels. Accordingly, the present invention should not be interpreted as being limited to the embodiments shown and discussed, but should be construed as further encompassing modifications thereof based on the principals set forth in this disclosure.

What is claimed is:

1. A modular structural panel system which includes individual modular interconnectable panels to assemble floors, interior and exterior walls, ceilings and roofing members for erecting buildings, houses and other structures without the need for conventional framing members, said system comprising:

a plurality of essentially identical structural panels, each panel of said panels including;

a first skin having a first surface and a second surface on opposing sides thereof;

a second skin having a first surface and a second surface on opposing sides thereof, wherein at least one of said first and second skins further comprises a water resistant, green board gypsum sheet;

a honeycomb core comprising a thermally expanded paper web which is impregnated with a phenolic resin and providing a plurality of honeycomb cells and having first and second sides corresponding to opposing sides of said honeycomb cells;

a first adhesive layer bonding the first surface of the first skin to said first side of said honeycomb core; and a second adhesive layer bonding the first surface of said second skin to said second side of said honeycomb core, said first and second adhesive layer each comprising a moisture-cured application of a non-volatile adhesive which is curable under ambient temperatures;

at least one of said first and second adhesive layers being substantially continuous over the associated first surface having a thickness of approximately five millimeters and having been cured under pressure distributed evenly over said first surface; in which:

each of said honeycomb cells further comprises a plurality of web members, each of said web members further including first and second opposing surfaces and first and second opposing ends thereof;

said first adhesive layer further comprising a first plurality of adhesive welds bonding a substantial portion of each of said first and second web surfaces to said first surface of said first skin, said adhesive weld being disposed substantially at said first end of each said web;

said second adhesive layer further comprising a second plurality of adhesive welds bonding a substantial portion of each of said first and second web surfaces to said first surface of said second skin, each adhesive weld being disposed substantially at said second end of each said web; and each weld of said first and second plurality of adhesive welds including a fillet having an approximate depth of at least one-sixteenth (1/16) of an inch;

wherein a structural member having significant resistance to creep between each of said first and second face skins and said honeycomb core as provided by said first plurality and said second plurality of adhesive welds.

2. The structural panel system as claimed in claim 1 in which:

said first and second adhesive layer each comprise a moisture-cured application of a one component adhesive.

3. The structural panel system as claimed in claim 2 in which:

said one component adhesive is urethane based.

4. The structural panel system as claimed in claim 1 in which:

said first and second adhesive layer each comprise a cured two component application of epoxy resin and hardener.

5. The structural panel system as claimed in claim 1 in which:

each of said plurality of honeycomb cells includes a first dimension directed along a first direction and a second dimension directed along a second direction;

said first and said second directions are substantially orthogonal with respect to each other; and said first dimension is larger than said second dimension in a substantial number of said plurality of honeycomb cells;

wherein a structural member having augmented structural strength in a predetermined direction is provided by substantially aligning said second dimension of each of said honeycomb cells in said predetermined direction.

6. The modular structural panel system as claim 1 in which:

an elongate portion of said honeycomb core of a first panel of said structural panels extends beyond edges of said first and second skins providing a tongue;

wherein said tongue engages and is adhesively bonded to a channel in a second panel of said structural panels.

7. The modular structural panel system as claimed in claim 1 in which:

a portion of said honeycomb core is removed from between said first and second skins of a first panel of said structural panels thereby providing a channel wherein said channel engages and is adhesively bonded to a tongue of a second panel of said structural panels.

8. The structural panel system as claimed in claim 1 further including:

insulation disposed within a number of said honeycomb cells.

9. A modular structural panel system which includes individual modular interconnectable panels to assemble floors, interior and exterior walls, ceilings and roofing members for erecting buildings, houses and other structures without the need for conventional framing members, said system comprising:

a plurality of essentially identical structural panels, each panel of said panels including a first face sheet having a first surface and a second surface on opposing sides thereof;

a second face sheet having a first surface and a second surface on opposing sides thereof at least one of said first and second face sheets further comprises a water resistant gypsum sheet;

a honeycomb core impregnated with a phenolic resin and comprising a plurality of honeycomb cells;

each of said plurality of honeycomb cells further comprising a plurality of web members, each of said web members further including a first edge and a second edge thereof;

a first plurality of adhesive welds bonding each of said first web edges to said first surface of said first face sheet; and a second plurality of adhesive welds bonding each of said second web edges to said first surface of said second face sheet;

each weld of said first and second plurality of adhesive welds comprising moisture curing, non-volatile adhesive cured under ambient temperature and between 5 and 10 pounds per square inch pressure distributed evenly over exterior surfaces of said first and second face sheets in an approximate depth of 1/16 of an inch;

wherein a building panel having significant resistance to creep between each of said face sheets and said honeycomb core is provided by said first plurality and said second plurality of adhesive welds.

10. The structural panel system of claim 9 in which:

said first plurality of adhesive welds and said second plurality of adhesive welds each comprise a moisture-cured application of a one component adhesive.

11. The structural panel system of claim 10 in which:

said one component adhesive is urethane based.

12. The structural panel system of claim 9 in which:

each of said plurality of honeycomb cells further includes a first dimension directed along a first direction and a second dimension directed along a second direction;

said first and said second directions being substantially orthogonal with respect to each other;

said first dimension is larger than said second dimension in a substantial number of said plurality of honeycomb cells;

wherein a structural building panel having augmented structural strength in a predetermined direction is provided by substantially aligning said second dimension of each of said honeycomb cells in said predetermined direction.

13. The modular structural panel system as claimed in claim 9 in which:

an elongate portion of said honeycomb core extends beyond the edges of said first and second skins of a first panel of said structural panels providing a tongue;

wherein said tongue engages and is adhesively bonded to a channel in a second panel of said structural panels.

14. The modular structural panel system as claimed in claim 9 in which:

a portion of said honeycomb core is removed from between said first and second skins a first panel of said structural panels thereby providing a channel;

wherein said channel engages and is adhesively bonded to a tongue of a second panel of said structural panels.

15. The structural panel system of claim 9 in which:

said first plurality of adhesive welds and said second plurality of adhesive welds each comprise a cured two component application of epoxy resin and hardener.

* * * * *